US011296447B2

(12) United States Patent
Horii

(10) Patent No.: US 11,296,447 B2
(45) Date of Patent: Apr. 5, 2022

(54) ELECTRICAL CONNECTOR FOR CIRCUIT BOARDS AND CIRCUIT-BOARD-MOUNTED ELECTRICAL CONNECTOR

(71) Applicant: HIROSE ELECTRIC CO., LTD., Kanagawa (JP)

(72) Inventor: Takao Horii, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/188,506

(22) Filed: Mar. 1, 2021

(65) Prior Publication Data

US 2021/0280999 A1 Sep. 9, 2021

(30) Foreign Application Priority Data

Mar. 5, 2020 (JP) ..... JP2020-038200

(51) Int. Cl.
*H01R 12/91* (2011.01)
*H01R 12/72* (2011.01)
(Continued)

(52) U.S. Cl.
CPC ..... *H01R 12/91* (2013.01); *H01R 12/7005* (2013.01); *H01R 12/716* (2013.01);
(Continued)

(58) Field of Classification Search
CPC .. H01R 12/91; H01R 12/7005; H01R 12/716; H01R 12/727; H01R 12/724;
(Continued)

(56) References Cited

U.S. PATENT DOCUMENTS 4,514,030 A * 4/1985 Triner ..... H01R 12/721 439/637
4,780,095 A * 10/1988 Classon ..... H01R 12/725 439/637
(Continued)

FOREIGN PATENT DOCUMENTS

DE 102017103604 A1 * 8/2017 ..... H01R 12/732
EP 3249752 A1 * 11/2017 ..... H01R 12/7035
(Continued)

*Primary Examiner* — Marcus E Harcum
(74) *Attorney, Agent, or Firm* — Rankin, Hill & Clark LLP

(57) ABSTRACT

An electrical connector for circuit boards includes: a terminal including a connecting portion for connection to a circuit board, the connecting portion being disposed on one end of the terminal, and a contact portion for contact with a counterpart connector element, the contact portion being disposed on the other end of the terminal; and a housing retaining the terminal and including a stationary housing for mounting to the circuit board through the terminal and a movable housing movable relative to the stationary housing and receiving the contact portion of the terminal. The terminal includes a stationary-side retained portion retained by the stationary housing, a movable-side retained portion retained by the movable housing, an elastic portion located between the stationary-side retained portion and the movable-side retained portion and elastically deformable, and a relay portion constituting a signal transmission path shorter than a total length of the elastic portion.

7 Claims, 8 Drawing Sheets

(51) Int. Cl.
*H01R 12/70* (2011.01)
*H01R 12/71* (2011.01)
*H01R 13/639* (2006.01)
*H01R 13/24* (2006.01)

(52) U.S. Cl.
CPC ..... *H01R 12/727* (2013.01); *H01R 13/24* (2013.01); *H01R 13/639* (2013.01)

(58) Field of Classification Search
CPC .. H01R 12/721; H01R 12/735; H01R 12/737; H01R 13/24; H01R 13/639
USPC ..... 439/246–248, 637, 891
See application file for complete search history.

(56) References Cited

U.S. PATENT DOCUMENTS 4,934,961 A * 6/1990 Piorunneck ..... H01R 43/16 439/59
6,663,402 B1 * 12/2003 Yu ..... H01R 13/6582 439/108
6,679,739 B2 * 1/2004 Fujita ..... H01R 13/11 439/862
6,699,068 B2 * 3/2004 Wu ..... H01R 12/724 439/594
6,764,345 B1 * 7/2004 Duesterhoeft ..... H01R 12/721 439/637
7,118,418 B1 * 10/2006 Huang ..... H01R 13/6581 439/637
7,374,432 B2 * 5/2008 Koguchi ..... H01R 12/725 439/247
10,686,273 B2 * 6/2020 Ogura ..... H01R 13/631
2004/0023537 A1 * 2/2004 Sasame ..... H01R 13/6485 439/181
2015/0044901 A1 * 2/2015 Doi ..... H01R 12/716 439/592
2019/0229455 A1 * 7/2019 Shimoji ..... H01R 12/91
2019/0334288 A1 10/2019 Horii
2020/0313327 A1 * 10/2020 Morita ..... H01R 12/737

FOREIGN PATENT DOCUMENTS

GN 107658591 A * 2/2018 ..... H01R 12/716
JP 2019-192524 A 10/2019
JP 2020087837 A * 6/2020 ..... H01R 13/112
TW I723724 B * 4/2021

* cited by examiner

ELECTRICAL CONNECTOR FOR CIRCUIT BOARDS AND CIRCUIT-BOARD-MOUNTED ELECTRICAL CONNECTOR

CROSS-REFERENCE TO RELATED APPLICATION

This application claims priority from Japanese Patent Application No. 2020-038200 filed with the Japan Patent Office on Mar. 5, 2020, the entire content of which is hereby incorporated by reference.

BACKGROUND

1. Technical Field

The present disclosure relates to an electrical connector for circuit boards mountable on a circuit board and a circuit-board-mounted electrical connector including the electrical connector for circuit boards mounted on the circuit board.

2. Related Art

For example, JP-A-2019-192524 discloses such an electrical connector for circuit boards. The electrical connector for circuit boards disclosed in JP-A-2019-192524 is a floating connector, and includes a stationary housing attached to a circuit board and a movable housing that is mated with a counterpart connector and movable relative to the stationary housing. Terminals are attached to the stationary housing and the movable housing in such a manner as to extend over the stationary housing and the movable housing. The terminal includes an elastic portion having a curved shape in an intermediate part, in the longitudinal direction, of the terminal. The movable housing is movable relative to the stationary housing due to elastic deformation of the elastic portion.

The terminal includes a connecting portion that extends from the stationary housing and is solder-connected to the circuit board on one end and a contact portion that is disposed on the movable housing and contactable with a terminal of a counterpart connector (counterpart terminal) on the other end. The elastic portion includes two curved portions, namely, an upper curved portion having a substantially U shape and a lower curved portion having a substantially inverted U shape. This increases a total length of the elastic portion, in other words, a spring length and ensures a large floating amount of the movable housing.

SUMMARY

An electrical connector for circuit boards according to an embodiment of the disclosure includes: a terminal including a connecting portion for connection to a circuit board, the connecting portion being disposed on one end of the terminal, and a contact portion for contact with a counterpart connector element, the contact portion being disposed on the other end of the terminal; and a housing retaining the terminal, the housing including a stationary housing for mounting to the circuit board through the terminal and a movable housing movable relative to the stationary housing and receiving the contact portion of the terminal. The terminal includes a stationary-side retained portion retained by the stationary housing, a movable-side retained portion retained by the movable housing, an elastic portion located between the stationary-side retained portion and the movable-side retained portion and elastically deformable, and a relay portion constituting a signal transmission path shorter than a total length of the elastic portion. The relay portion short-circuits a part located at a position closer to the one end than the elastic portion is and a part located at a position closer to the other end than the elastic portion is or short-circuits both ends of a part of the elastic portion.

DETAILED DESCRIPTION

Figure 1B:
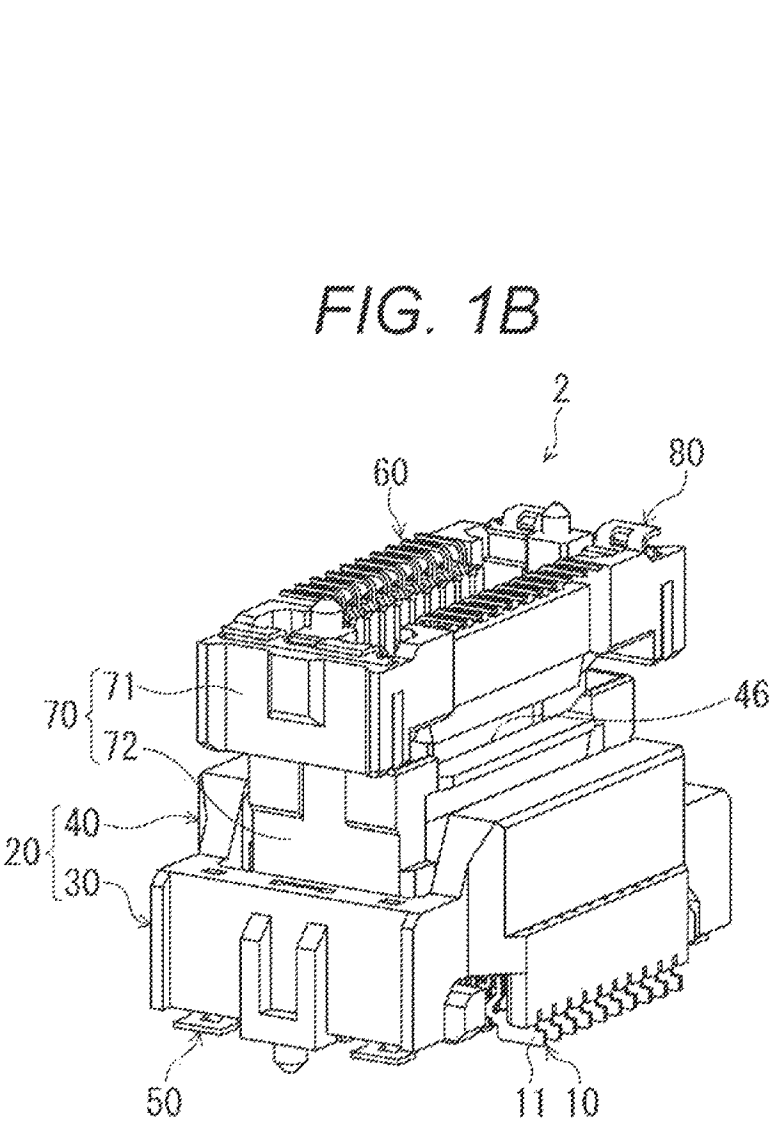
FIG. 1B is a perspective view of the plug connector and the receptacle connector according to the first embodiment of the disclosure in a mated state.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the terminal of the electrical connector for circuit boards disclosed in JP-A-2019-192524, the elastic portion located between the contact portion and the connecting portion constitutes a signal transmission path throughout its entire length. The elastic portion has a long total length and a complicated shape as a whole due to the two curved portions. Thus, in terms of signal transmission, it is not easy to ensure a sufficient electrical characteristic. For example, when a signal to be transmitted is a high-speed signal, the impedance may become extremely high.

In view of the above circumstances, it is an object of the present disclosure to provide an electrical connector for circuit boards and a circuit-board-mounted electrical connector that are capable of ensuring a sufficient electrical characteristic while allowing a movable housing to float.

According to the present disclosure, the above object is achieved by electrical connectors for circuit boards according to first and second aspects of the disclosure and a circuit-board-mounted electrical connector according to a third aspect of the disclosure.

First Aspect

An electrical connector for circuit boards according to the first aspect of the disclosure includes: a terminal including a connecting portion for connection to a circuit board, the connecting portion being disposed on one end of the terminal, and a contact portion for contact with a counterpart connector element, the contact portion being disposed on the other end of the terminal; and a housing retaining the terminal, the housing including a stationary housing for mounting to the circuit board through the terminal and a movable housing movable relative to the stationary housing and receiving the contact portion of the terminal.

In the first aspect, in the electrical connector for circuit boards, the terminal includes a stationary-side retained portion retained by the stationary housing, a movable-side retained portion retained by the movable housing, an elastic portion located between the stationary-side retained portion and the movable-side retained portion and elastically deformable, and a relay portion constituting a signal transmission path shorter than a total length of the elastic portion. The relay portion short-circuits a part located at a position closer to the one end than the elastic portion is and a part located at a position closer to the other end than the elastic portion is or short-circuits both ends of a part of the elastic portion.

In the first aspect, the terminal includes the relay portion constituting the signal transmission path shorter than the total length of the elastic portion separately from the elastic portion. Thus, a signal is more likely to flow through the signal transmission path constituted from the relay portion than through the signal transmission path extending over the entire elastic portion. Thus, in the first aspect, a sufficient floating amount is ensured by the elastic portion having a sufficient spring length. In addition, a sufficient electrical characteristic for signal transmission is also ensured by the relay portion constituting the signal transmission path shorter than the total length of the elastic portion.

In the first aspect, the relay portion may include a first relay piece extending from the position closer to the one end than the elastic portion is toward the position closer to the other end than the elastic portion is and a second relay piece extending from the position closer to the other end than the elastic portion is toward the position closer to the one end than the elastic portion is, the first relay piece and the second relay piece being in elastic contact with each other. A total length of the first relay piece and the second relay piece in a contact state may be shorter than the total length of the elastic portion.

In such configuration in which the relay portion includes the first relay piece and the second relay piece, the total length of the first relay piece and the second relay piece in the contact state, in other words, the length between the position closer to the one end than the elastic portion is and the position closer to the other end than the elastic portion is shorter than the total length of the elastic portion. Thus, the signal transmission path passing through the first relay piece and the second relay piece is shorter than the total length of the elastic portion. Therefore, a sufficient electrical characteristic for signal transmission is ensured. Moreover, even if the movable housing moves (floats) relative to the stationary housing, both the first relay piece and the second relay piece elastically deform, thereby maintaining the contact state between the first and second relay pieces. Thus, the signal transmission path passing through the first relay piece and the second relay piece can be ensured without being affected by the floating.

In the first aspect, the relay portion may include an elastic piece extending from the position closer to the one end than the elastic portion is toward the position closer to the other end than the elastic portion is or an elastic piece extending from the position closer to the other end than the elastic portion is toward the position closer to the one end than the elastic portion is. A total length of the relay portion may be shorter than the total length of the elastic portion.

When the relay portion includes the elastic piece extending from the position closer to the one end than the elastic portion is toward the position closer to the other end than the elastic portion is, a free end part of the elastic piece comes into contact with the terminal at the position closer to the other end than the elastic portion is to constitute the signal transmission path passing through the relay portion. On the other hand, when the relay portion includes the elastic piece extending from the position closer to the other end than the elastic portion is toward the position closer to the one end than the elastic portion is, a free end part of the elastic piece comes into contact with the terminal at the position closer to the one end than the elastic portion is to constitute the signal transmission path passing through the relay portion. The total length of the relay portion is shorter than the total length of the elastic portion. In other words, the signal transmission path passing through the relay portion is shorter than the total length of the elastic portion. Thus, a sufficient electrical characteristic for signal transmission is ensured. Moreover, even if the movable housing moves (floats) relative to the stationary housing, the relay portion elastically deforms, thereby maintaining the contact state described above. Thus, the signal transmission path passing through the relay portion can be ensured without being affected by the floating.

In the first aspect, the terminal may be made of a sheet metal. The relay portion may be elastically deformable in a through-thickness direction parallel to a mounting surface of the circuit board. With such a configuration, especially when the movable housing floats in the direction parallel to the mounting surface of the circuit board, the signal transmission path passing through the relay portion can be more reliably ensured.

In the first aspect, the terminal may be made of a sheet metal. The elastic portion may have a strip shape bent in a through-thickness direction and may be disposed with a strip-width direction parallel to a mounting surface of the circuit board. The relay portion may include a relay piece having a cantilever form cut and raised from a part of the elastic portion and having elasticity. The relay portion may be in elastic contact with the elastic portion in a free end part of the relay piece. A total length of the relay portion may be shorter than the total length of the elastic portion.

In such a configuration, the total length of the relay piece is shorter than the total length of the elastic portion. In other words, the signal transmission path passing through the relay piece is shorter than the total length of the elastic portion. Thus, even if the movable housing floats, the relay piece elastically deforms, thereby maintaining the contact state with the elastic portion. Therefore, the signal transmission path passing through the relay portion can be ensured without being affected by the floating.

Second Aspect

An electrical connector for circuit boards according to the second aspect of the disclosure includes: a terminal including a connecting portion for connection to a circuit board, the connecting portion being disposed on one end of the terminal, and a contact portion for contact with a counterpart connector element, the contact portion being disposed on the other end of the terminal, and a housing retaining the terminal, the housing including a stationary housing for mounting to the circuit board through the terminal and a movable housing movable relative to the stationary housing and receiving the contact portion of the terminal.

In the second aspect, in the electrical connector for circuit boards, the terminal includes a stationary-side retained portion retained by the stationary housing, a movable-side retained portion retained by the movable housing, and an elastic portion located between the stationary-side retained portion and the movable-side retained portion and elastically deformable. The electrical connector for circuit boards further includes a relay member configured as a member separate from the terminal. The relay member makes contact with the terminal at both a position closer to the one end than the elastic portion is and a position closer to the other end than the elastic portion is to constitute a signal transmission path shorter than a total length of the elastic portion and short-circuits parts located at both the positions.

In the second aspect, the relay member configured as a member separate from the terminal is provided to constitute the signal transmission path shorter than the total length of the elastic portion. Consequently, a signal is more likely to flow through the signal transmission path constituted from the relay member than through the signal transmission path extending over the entire elastic portion. Thus, as with the first aspect described above, a sufficient floating amount is ensured by the elastic portion. In addition, a sufficient electrical characteristic for signal transmission is also ensured.

Third Aspect

A circuit-board-mounted electrical connector according to the third aspect of the disclosure includes: a circuit board; and an electrical connector mounted on the circuit board. The electrical connector includes a terminal including a connecting portion for connection to the circuit board, the connecting portion being disposed on one end of the terminal, and a contact portion for contact with a counterpart connector element, the contact portion being disposed on the other end of the terminal, and a housing retaining the terminal, the housing including a stationary housing for mounting to the circuit board through the terminal and a movable housing movable relative to the stationary housing and receiving the contact portion of the terminal.

In the third aspect, in the circuit-board-mounted electrical connector, the terminal includes a stationary-side retained portion retained by the stationary housing, a movable-side retained portion retained by the movable housing, an elastic portion located between the stationary-side retained portion and the movable-side retained portion and elastically deformable, and a relay contact portion disposed at a position closer to the other end than the elastic portion is. The circuit board includes a circuit portion exposed on a mounting surface of the circuit board, the circuit portion including a first pad contactable with the connecting portion, a second pad contactable with the relay contact portion, and a signal transmission portion shorter than a total length of the elastic portion and connecting the first pad and the second pad. The relay contact portion and the circuit portion constitute a signal transmission path shorter than the total length of the elastic portion and short-circuit a part of the terminal located at a position closer to the other end than the elastic portion is and the second pad of the circuit portion in a state where the electrical connector is mounted on the circuit board.

In the third aspect, in the state where the electrical connector is mounted on the circuit board, the connecting portion of the terminal is in contact with the first pad of the circuit board, and the relay contact portion of the terminal is in contact with the second pad of the circuit board. The relay contact portion makes contact with the second pad to constitute the signal transmission path passing through the relay contact portion and the circuit portion. In the third aspect, the signal transmission path passing through the signal transmission portion is shorter than the total length of the elastic portion of the terminal. Thus, a signal is more likely to flow through the signal transmission path constituted from the signal transmission portion than through the signal transmission path extending over the entire elastic portion. Therefore, as with the first and second aspects described above, a sufficient floating amount is ensured by the elastic portion. In addition, a sufficient electrical characteristic for signal transmission is also ensured.

According to the present disclosure, the signal transmission path shorter than the total length of the elastic portion is formed in a part different from the elastic portion in the terminal. Thus, it is possible to ensure a sufficient electrical characteristic for signal transmission while allowing the movable housing to float.

Hereinbelow, embodiments of the disclosure will be described with reference to the accompanying drawings.

First Embodiment

A plug connector 1 according to a first embodiment is an electrical connector for circuit boards mounted on a mounting surface of a circuit board (not illustrated). A receptacle connector 2 serving as a counterpart connector element (counterpart connector) of the plug connector 1 is an electrical connector for circuit boards mounted on a mounting surface of another circuit board (not illustrated). The plug connector 1 and the receptacle connector 2 are mated with each other with the mounting surfaces of the respective circuit boards parallel to each other in a connector mating direction corresponding to an up-down direction (Z-axis direction) perpendicular to the mounting surfaces. In the present embodiment, the receptacle connector 2 is mated to the plug connector 1 from above.

Figure 2B:
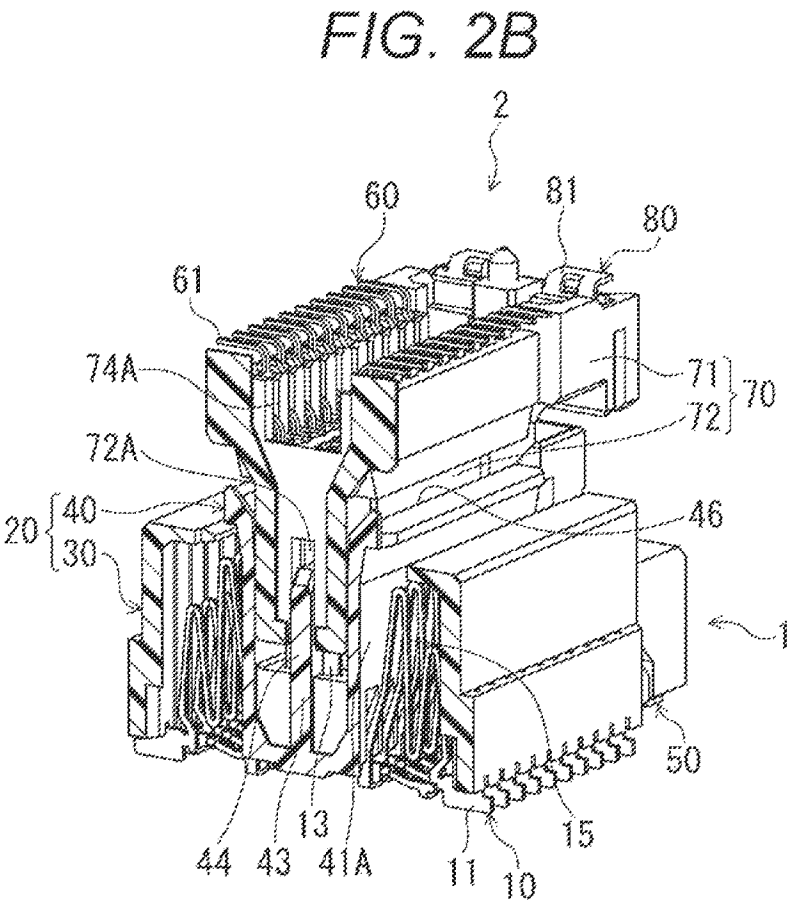
FIG. 2B is a perspective sectional view of the plug connector and the receptacle connector of FIG. 1 in the mated state, illustrating the sections on the plane perpendicular to the terminal array direction.
Figure 2A:
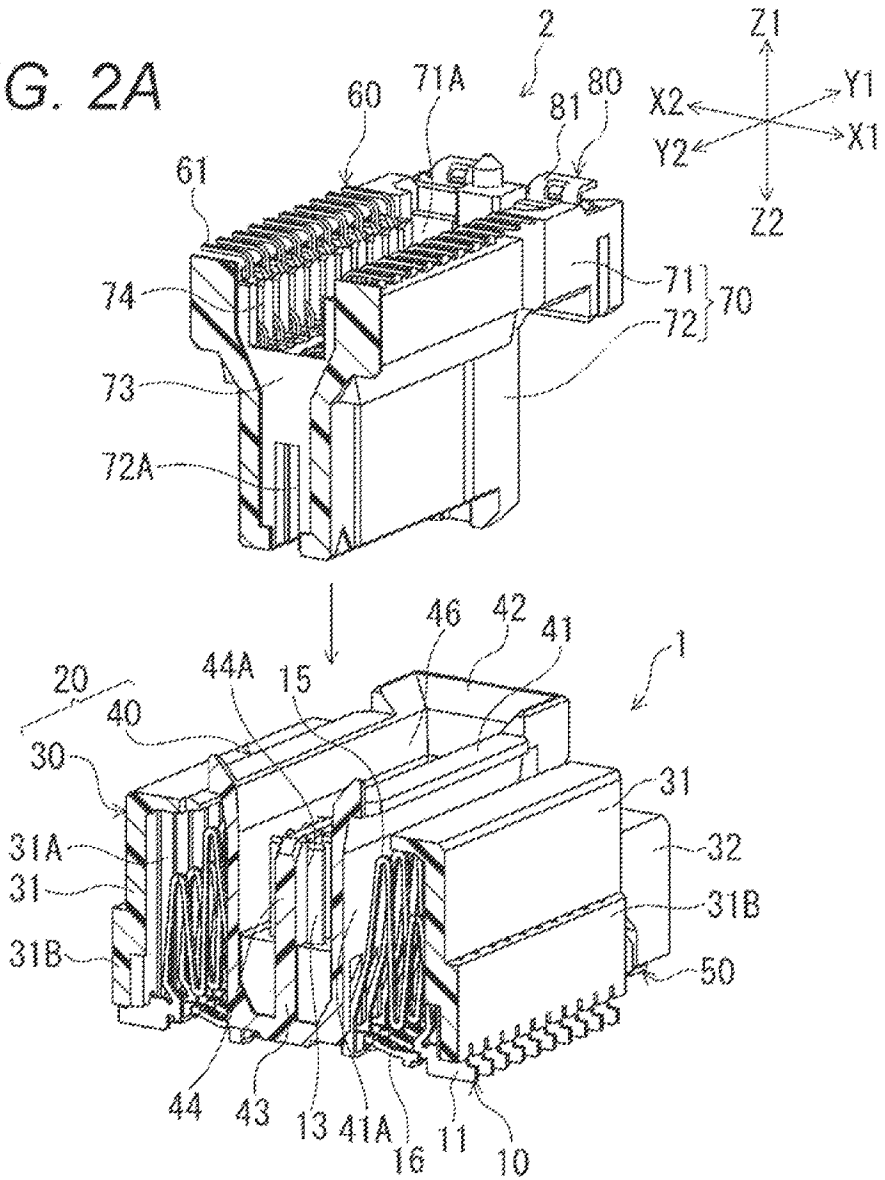
FIG. 2A is a perspective sectional view of the plug connector and the receptacle connector of FIG. 1 in the unmated state, illustrating sections on a plane perpendicular to a terminal array direction.
Figure 3:
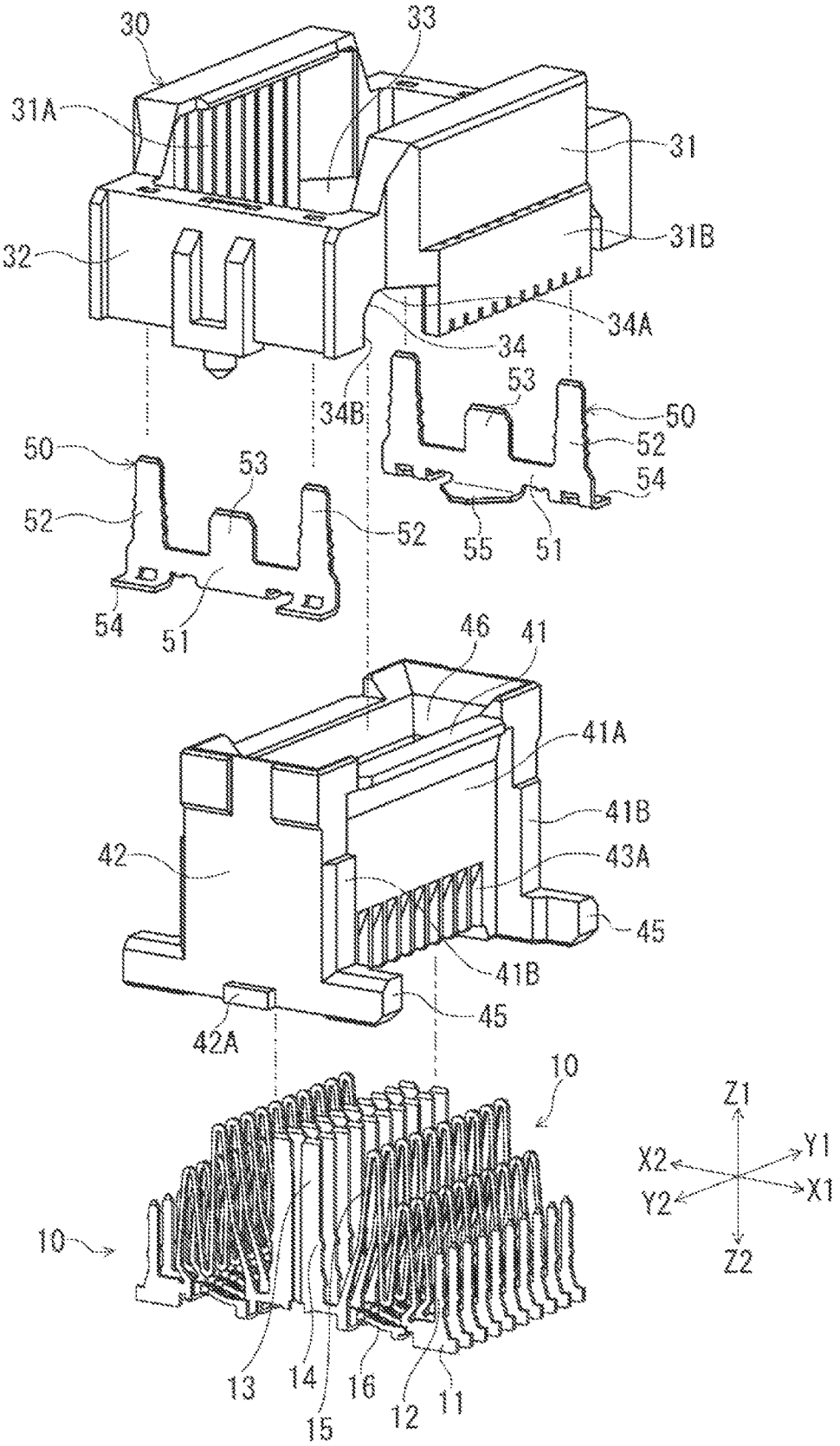
FIG. 3 is a perspective view of members of the plug connector of FIG. 1 in a separated state.

The plug connector 1 includes a plurality of plug terminals 10 made of metal, the plug terminals 10 being arranged in a terminal array direction corresponding to one direction parallel to the mounting surface of the circuit board (Y-axis direction in the present embodiment), a plug housing 20 that is made of an electrical insulating material (e.g., resin) and retains the plug terminals 10, and plug fixing fittings 50 that are made of metal and retained on respective ends, in the terminal array direction, of the plug housing 20. As can be seen in FIGS. 2A, 2B, and 3, the plug terminals 10 are arranged in two rows. The two rows of plug terminals 10 are opposed to each other with symmetrical orientations in a connector-width direction (X-axis direction) perpendicular to both the terminal array direction (Y-axis direction) and the up-down direction (Z-axis direction).

Figure 4:
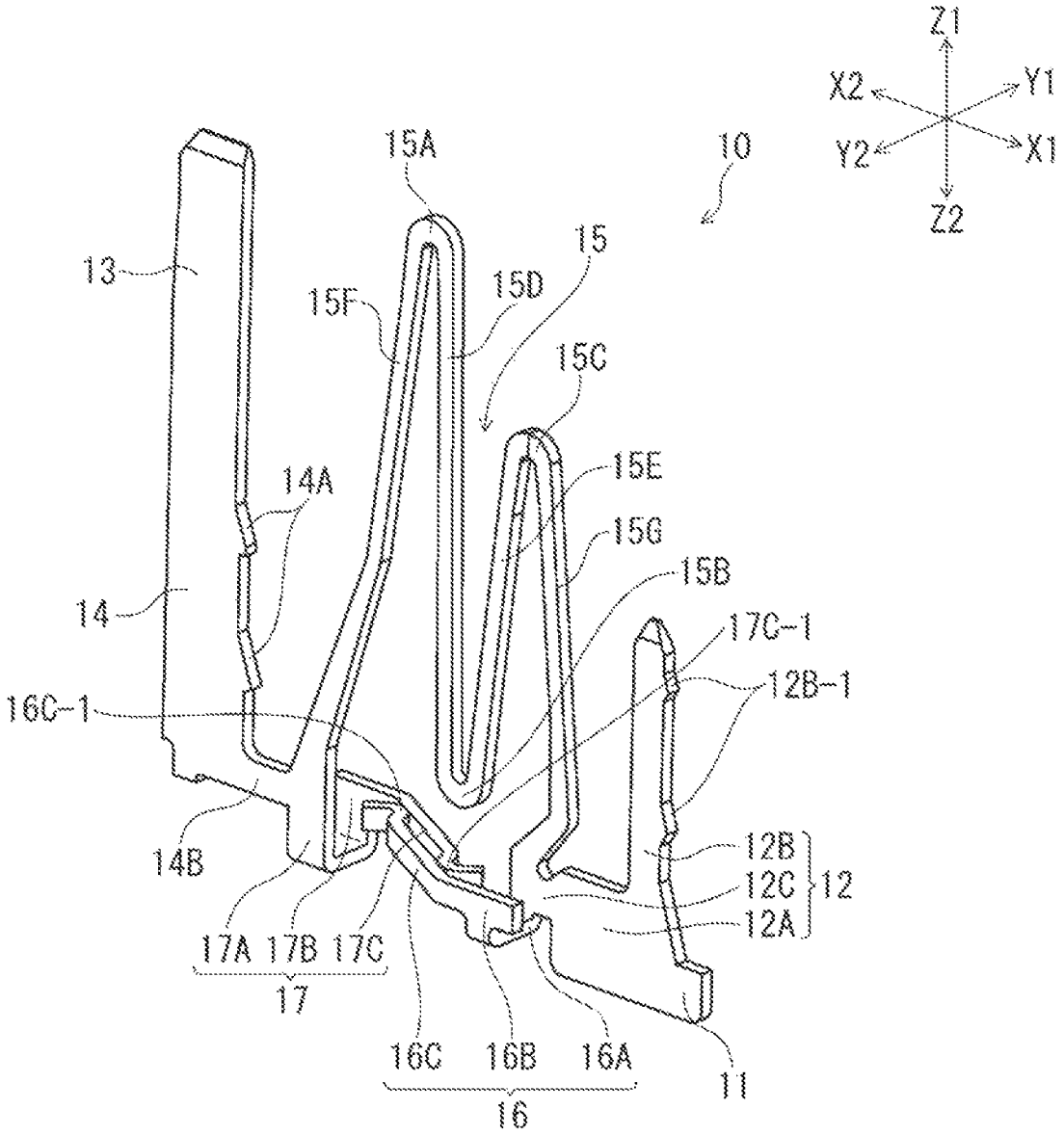
FIG. 4 is a perspective view of one plug terminal of the plug connector of FIG. 1.

FIG. 4 is a perspective view of one plug terminal 10. As can be seen in FIG. 4, the plug terminal 10 is a male terminal that is made by punching out a sheet metal member in the through-thickness direction and includes a bent part. The plug terminal 10 includes a connecting portion 11, a stationary-side retained portion 12, a contact portion 13, a movable-side retained portion 14, an elastic portion 15, a stationary-side relay piece 16 serving as a first relay piece, and a movable-side relay piece 17 serving as a second relay piece.

The connecting portion 11 extends in the connector-width direction (X-axis direction) on one end of the plug terminal 10 and is solder-connected, on the lower end thereof, to the corresponding circuitry of the mounting surface of the circuit board. The stationary-side retained portion 12 includes a base portion 12A extending upward from the connecting portion 11, a retained arm portion 12B linearly extending upward from the base portion 12A at a position on the outer side, in the connector-width direction, of the base portion 12A (X1 side in FIG. 4), and a stationary-side coupling portion 12C that projects inward in the connector-width direction (X2 direction in FIG. 4) from the base portion 12A and is coupled to one end of the elastic portion 15. The retained arm portion 12B includes two stationary-side retained projections 12B-1 projecting from a side edge (the side edge extending in the up-down direction) located on the outer side in the connector-width direction (X1 side in FIG. 4). The retained arm portion 12B is press-fitted into a stationary-side retaining portion (not illustrated, described later) of a stationary housing 30 from below and retained by the stationary housing 30 through the stationary-side retained projections 12B-1 biting into an inner wall surface of the stationary-side retaining portion.

The contact portion 13 linearly extends in the up-down direction on the other end of the plug terminal 10. The contact portion 13 is held between and pressed by a pair of contact pieces (not illustrated) of a receptacle terminal 60 (described later) on both major faces perpendicular to the terminal array direction (Y-axis direction) and thus comes into contact with the pair of contact pieces. The movable-side retained portion 14 extends downward from the lower end of the contact portion 13 and includes two movable-side retained projections 14A projecting from a side edge (the edge extending in the up-down direction) located on the outer side in the connector-width direction (X1 side in FIG. 4). The movable-side retained portion 14 further includes a movable-side coupling portion 14B that extends outward in the connector-width direction (X1 direction) from a lower part of the side edge and is coupled to the other end of the elastic portion 15. The movable-side retained portion 14 is press-fitted into a bottom groove 43A (described later) of the stationary housing 30 from below and retained by the stationary housing 30 through the movable-side retained projections 14A biting into an inner wall surface of the bottom groove 43A. The movable-side retained portion 14 is disposed at the same position as the base portion 12A and the stationary-side coupling portion 12C in the terminal array direction. In other words, the movable-side retained portion 14, the base portion 12A, and the stationary-side coupling portion 12C are located on a straight line (a virtual line extending in the X-axis direction) when viewed from above (refer to FIG. 5A).

The elastic portion 15 rises from the stationary-side coupling portion 12C and the movable-side coupling portion 14B and has a substantially M shape as a whole. The elastic portion 15 has a strip shape narrower than the stationary-side retained arm portion 12B and the movable-side retained portion 14. The elastic portion 15 includes two bent portions 15A and 15C each having a curved shape in an upper part thereof, a bent portion 15B having a curved shape in a lower part thereof, an inner long arm portion 15D connecting the bent portion 15A and bent portion 15B, an inner short arm portion 15E connecting the bent portion 15C and bent portion 15B, an outer long arm portion 15F connecting the bent portion 15A and the movable-side coupling portion 14B, and an outer short arm portion 15G connecting the bent portion 15C and the stationary-side coupling portion 12C. In the present embodiment, the inner long arm portion 15D and the outer long arm portion 15F have substantially the same length as each other, whereas the inner short arm portion 15E and the outer short arm portion 15G have substantially the same length as each other. Since the inner long arm portion 15D and the outer long arm portion 15F are longer than the inner short arm portion 15E and the outer short arm portion 15G, the bent portion 15A is located above the bent portion 15C as can be seen in FIG. 4.

The elastic portion 15 has a substantially M shape coupling three waveform portions, namely, a waveform portion that has an inverted U shape and includes the bent portion 15A on the upper end, a waveform portion that has a U shape and includes the bent portion 15B on the lower end, and a waveform portion that has an inverted U shape and includes the bent portion 15C on the upper end. In the three waveform portions, the arm portions adjacent to each other, namely, the inner long arm portion 15D and the outer long arm portion 15F, the inner long arm portion 15D and the inner short arm portion 15E, and the inner short arm portion 15E and the outer short arm portion 15G constitute widened parts each inclined in such a manner as to expand the opening width of the waveform as being away from the bent portion 15A, the bent portion 15B, or the bent portion 15C.

The elastic portion 15 is elastically deformable by the arm portions 15D, 15E, 15F, and 15G, which are adjacent to each other in the connector-width direction, displacing in such a manner as to expand or narrow the distance therebetween, in other words, the widened parts described above about the bent portions 15A, 15B, and 15C serving as fulcrums. The elastic portion 15 is also elastically deformable in the through-thickness direction thereof, that is, the terminal array direction (Y-axis direction) and also elastically deformable in the up-down direction (Z-axis direction) within a range of a width dimension (the dimension in the up-down direction) of the relay pieces 16, 17 serving as the relay portion (described later). In the present embodiment, as described above, the substantially M shape of the elastic portion 15 increases the total length of the elastic portion 15, that is, the total length of the elastic portion 15 along the substantially M shape. As a result, the elastic portion 15 can be elastically deformed with a sufficient spring length.

The stationary-side relay piece 16 includes a stationary-side transitional portion 16A extending from the stationary-side coupling portion 12C to a stationary-side base end portion 16B (described below), the stationary-side base end portion 16B that is coupled to the stationary-side transitional portion 16A and extends in the connector-width direction, and a stationary-side elastic piece 16C extending inward in the connector-width direction (X2 direction in FIG. 4) from the stationary-side base end portion 16B.

The stationary-side transitional portion 16A is bent on the lower edge of the stationary-side coupling portion 12C, extends toward the stationary-side base end portion 16B in the terminal array direction (Y2 side in FIG. 4), and is coupled to the lower edge of the stationary-side base end portion 16B. The stationary-side base end portion 16B has major faces parallel to the up-down direction and extends in the connector-width direction. The stationary-side elastic piece 16C has major faces parallel to the up-down direction and extends inward (X2 direction in FIG. 4) from the inner end, in the connector-width direction, of the stationary-side base end portion 16B (the end at the X2 side in FIG. 4) at an inclination toward a movable-side elastic piece 17C (described later) (Y1 side in FIG. 4). The stationary-side elastic piece 16C includes, in a free end part thereof (the part located at the X2 side in FIG. 4), a stationary-side contact portion 16C-1 for making elastic contact with the movable-side elastic piece 17C. The stationary-side contact portion 16C-1 is bent in such a manner as to project toward the movable-side elastic piece 17C.

The movable-side relay piece 17 includes a movable-side transitional portion 17A extending from the movable-side coupling portion 14B to a movable-side base end portion 17B (described below), the movable-side base end portion 17B that is coupled to the movable-side transitional portion 17A and extends in the connector-width direction, and the movable-side elastic piece 17C extending outward in the connector-width direction (X1 direction in FIG. 4) from the movable-side base end portion 17B.

As can be seen in FIG. 4, the movable-side transitional portion 17A extends in a substantially U shape from the lower edge of the movable-side coupling portion 14B and is coupled to the lower edge of the movable-side base end portion 17B. Specifically, the movable-side transitional portion 17A extends straight downward from the lower edge of the movable-side coupling portion 14B, is bent and extends toward the movable-side base end portion 17B (Y1 side in FIG. 4), is further bent and extends upward, and is coupled to the lower edge of the movable-side base end portion 17B. That is, the movable-side transitional portion 17A has a substantially U shape when viewed in the connector-wide direction.

The movable-side base end portion 17B has major faces parallel to the up-down direction and extends in the connector-width direction. The movable-side elastic piece 17C has major faces parallel to the up-down direction and extends outward (X1 direction in FIG. 4) from the outer end, in the connector-width direction, of the movable-side base end portion 17B (the end at the X1 side in FIG. 4) at an inclination toward the stationary-side elastic piece 16C of the stationary-side relay piece 16 (Y2 side in FIG. 4). The movable-side elastic piece 17C includes, in a free end part thereof (the part located at the X1 side in FIG. 4), a movable-side contact portion 17C-1 for making elastic contact with the stationary-side elastic piece 16C. The movable-side contact portion 17C-1 is bent in such a manner as to project toward the stationary-side elastic piece 16C.

Figure 5B:
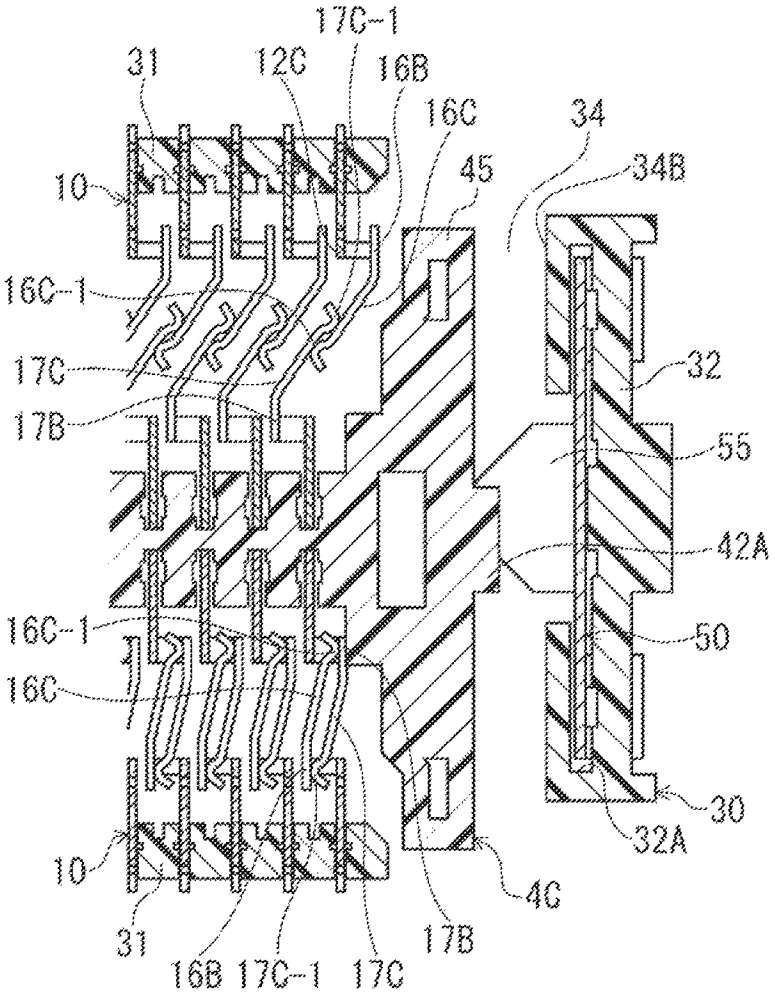
FIG. 5B is a sectional view of the part of the plug connector of a part of the plug connector of FIG. 1 on the plane perpendicular to the up-down direction, illustrating a state where the movable housing floats.
Figure 5A:
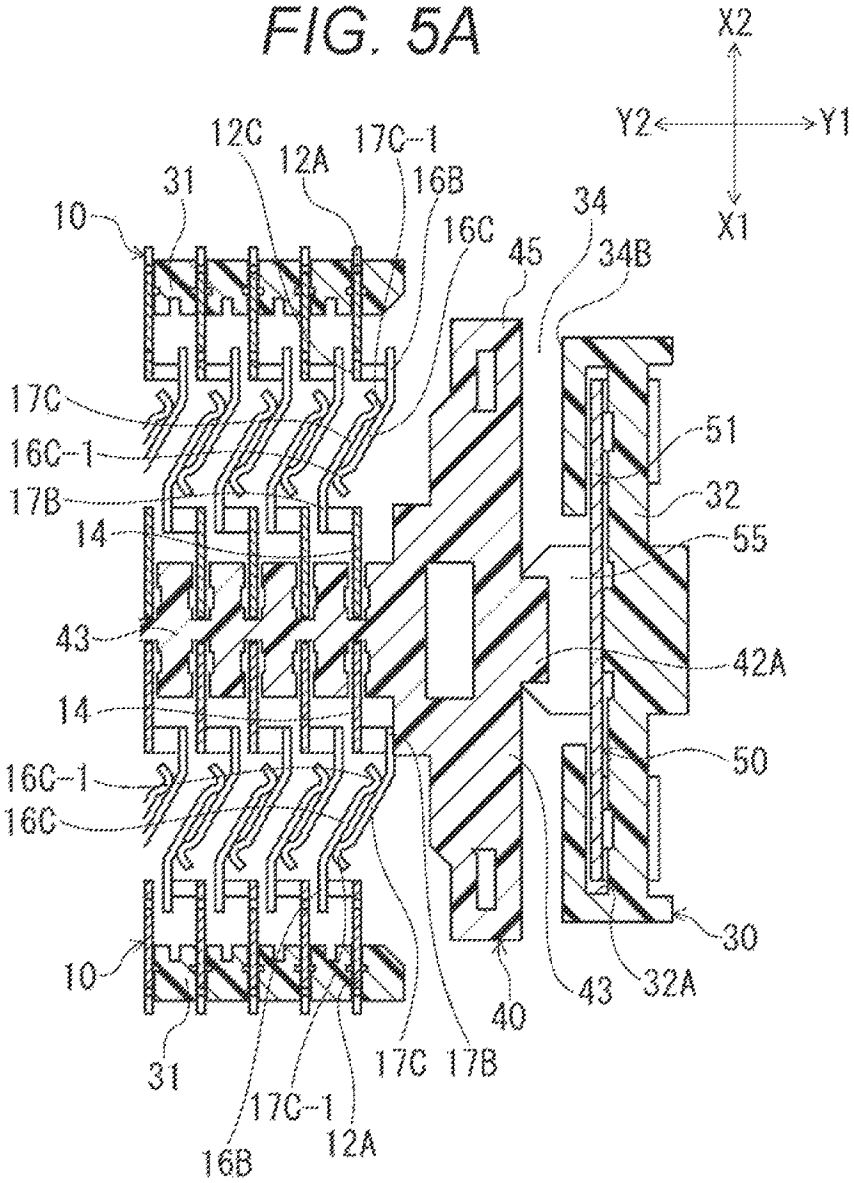
FIG. 5A is a sectional view of a part of the plug connector of FIG. 1 on a plane perpendicular to an up-down direction, illustrating a state where a movable housing is located at a regular position.

In the present embodiment, in the terminal array located at the X1 side in the connector-width direction (X-axis direction), that is, the terminal array located in the lower half in FIGS. 5A and 5B, the stationary-side relay piece 16 is located at the Y2 side, whereas the movable-side relay piece 17 is located at the Y1 side in the terminal array direction (Y-axis direction) (refer to FIGS. 5A and 5B). On the other hand, in the terminal array located at the X2 side in the connector-width direction (X-axis direction), that is, the terminal array located in the upper half in FIGS. 5A and 5B, the stationary-side relay piece 16 is located at the Y1 side, whereas the movable-side relay piece 17 is located at the Y2 side in the terminal array direction (Y-axis direction) (refer to FIGS. 5A and 5B).

In the present embodiment, the stationary-side elastic piece 16C of the stationary-side relay piece 16 and the movable-side elastic piece 17C of the movable-side relay piece 17 have substantially the same length as each other and extend in parallel with the same inclination angle as each other (also refer to FIG. 5A). The stationary-side relay piece 16 and the movable-side relay piece 17 (hereinbelow, collectively referred to as the "relay pieces 16 and 17" for convenience of description when distinction therebetween is not necessary) extend beyond a straight line passing through the base portion 12A, the stationary-side coupling portion 12C, and the movable-side retained portion 14 (a virtual line extending in the X-axis direction) when viewed from above (refer to FIG. 5A). Specifically, in the terminal array located at the X1 side in the connector-width direction (X-axis direction), the stationary-side relay piece 16 extends from the Y2 side toward the Y1 side relative to the above-mentioned straight line, whereas the movable-side relay piece 17 extends from the Y1 side toward the Y2 side relative to the above-mentioned straight line. On the other hand, in the terminal array located at the X2 side in the connector-width direction (X-axis direction), the stationary-side relay piece 16 extends from the Y1 side toward the Y2 side relative to the above-mentioned straight line, whereas the movable-side relay piece 17 extends from the Y2 side toward the Y1 side relative to the above-mentioned straight line.

In a state where a movable housing 40 is located at a regular position, that is, where the movable housing 40 is not floating, the stationary-side contact portion 16C-1 of the stationary-side elastic piece 16C is in contact, with contact pressure, with the major face (the major face located at the Y2 side in FIG. 4) of the movable-side elastic piece 17C at a position close to the inner end, in the connector-width direction, of the movable-side elastic piece 17C (the position close to the movable-side base end portion 17B) (also refer to FIG. 5A). On the other hand, the movable-side contact portion 17C-1 of the movable-side elastic piece 17C is in contact, with contact pressure, with the major face (the major face located at the Y1 side in FIG. 4) of the stationary-side elastic piece 16C at a position close to the outer end, in the connector-width direction, of the stationary-side elastic piece 16C (the position close to the stationary-side base end portion 16B) (also refer to FIG. 5A).

In the present embodiment, a total length of the relay pieces 16 and 17 in the contact state, in other words, the length from a junction position between the stationary-side transitional portion 16A and the stationary-side coupling portion 12C through a junction position between the movable-side transitional portion 17A and the movable-side coupling portion 14B is shorter than the total length of the elastic portion 15.

The stationary-side elastic piece 16C and the movable-side elastic piece 17C making elastic contact with each other constitute a signal transmission path passing through the stationary-side relay piece 16 and the movable-side relay piece 17 separately from a signal transmission path passing through the elastic portion 15. As described above, the total length of the relay pieces 16 and 17 in the contact state is shorter than the total length of the elastic portion 15. Thus, the signal transmission path formed by the relay pieces 16 and 17 is shorter than the signal transmission path passing through the elastic portion 15. Thus, a signal transmitted in the plug terminal 10 is more likely to flow through the signal transmission path passing through the relay pieces 16 and 17 than through the signal transmission path passing through the entire elastic portion 15. That is, in the plug terminal 10, the relay pieces 16 and 17 short-circuit the stationary-side coupling portion 12C located closer to the one end than the elastic portion 15 is and the movable-side coupling portion 14B located closer to the other end than the elastic portion 15 is.

In the present embodiment, a sufficient floating amount is ensured by the elastic portion 15 having a sufficient spring length. In addition, a sufficient electrical characteristic for signal transmission can also be ensured by the relay pieces 16 and 17 constituting the signal transmission path shorter than the total length of the elastic portion 15 separately from the elastic portion 15.

The plug housing 20 is disposed with the longitudinal direction aligned with the terminal array direction (Y-axis direction) and the widthwise direction aligned with the connector-width direction (X-axis direction). The plug housing 20 includes the stationary housing 30 for mounting to the circuit board through the plug terminals 10 and the movable housing 40 that is configured as a member separate from the stationary housing 30, is movable relative to the stationary housing 30, and receives the contact portions 13 of the plug terminals 10.

Figure 1A:
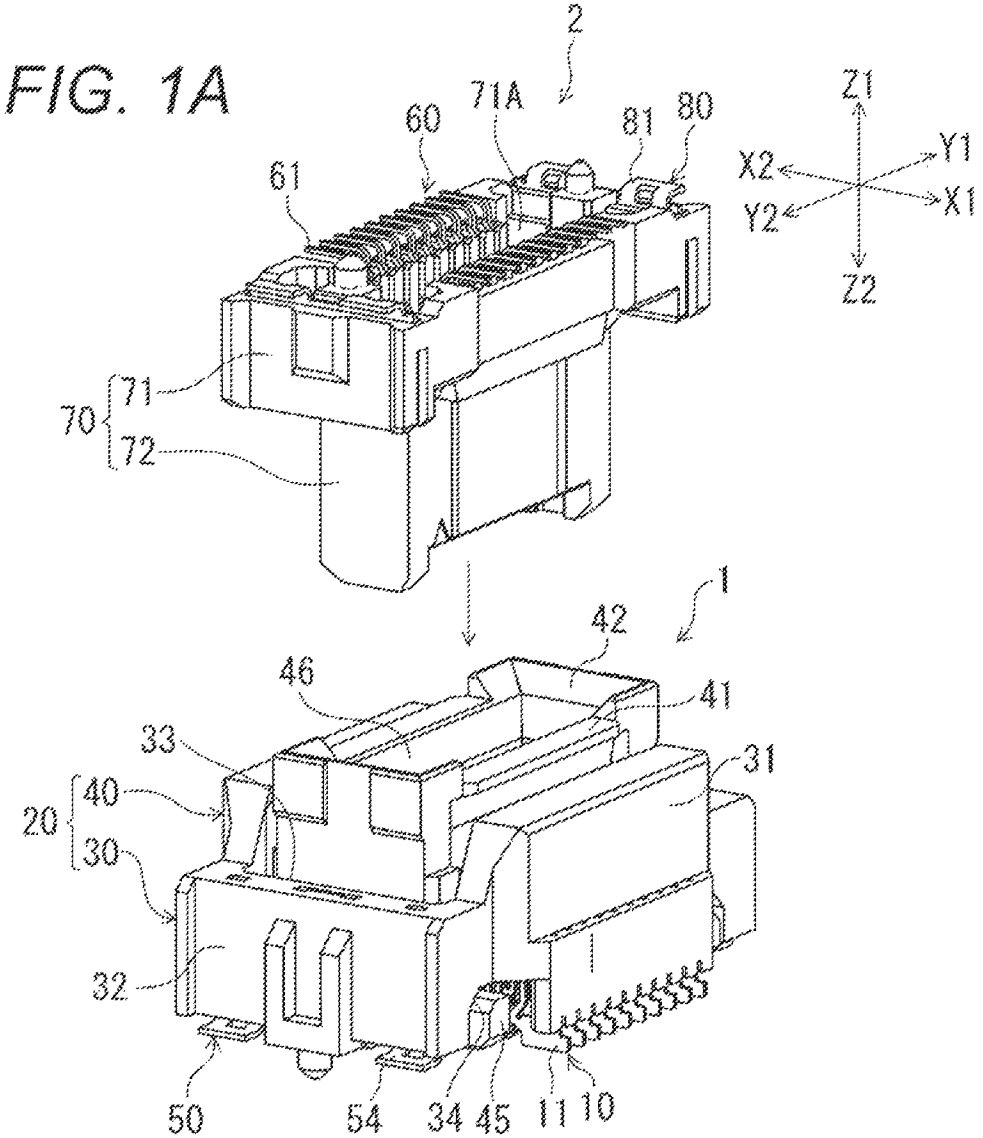
FIG. 1A is a perspective view of a plug connector and a receptacle connector according to a first embodiment of the disclosure in an unmated state.

The stationary housing 30 includes a pair of side walls 31 extending in the terminal array direction and a pair of end walls 32 that extends in the connector-width direction and couples ends of the pair of side walls 31, the pair of side walls 31 and the pair of end walls 32 constituting a peripheral wall. As can be seen in FIGS. 1A and 1B, the side walls 31 are higher than the end walls 32 (also refer to FIG. 3). A space that is surrounded by the pair of side walls 31 and the pair of end walls 32 and penetrates the stationary housing 30 in the up-down direction constitutes a central space 33 that receives the movable housing 40 from below (also refer to FIG. 3).

Each of the side walls 31 includes a stationary-side housing portion 31A for housing a part of the elastic portion 15 of each plug terminal 10. The stationary-side housing portion 31A is recessed from an inner wall surface of the side wall 31 and extends in the up-down direction. The stationary-side housing portion 31A extends within a range from a position close to the upper end of the side wall 31 through the lower end thereof in the up-down direction, and has a closed upper end and an open lower end. As can be seen in FIG. 2A, when the elastic portion 15 of the plug terminal 10 is in a free state, the stationary-side housing portion 31A houses the inner short arm portion 15E, the bent portion 15C, and the outer short arm portion 15G of the elastic portion 15. An outer wall surface of the lower half part of the side wall 31 projects in the entire area in the terminal array direction to constitute a projecting wall 31B. The projecting wall 31B includes, at a position corresponding to each plug terminal 10, the stationary-side retaining portion (not illustrated) that retains the retained arm portion 12B of the plug terminal 10 press-fitted therein. The stationary-side retaining portion extends in the up-down direction, is open downward, and is formed in a slit-like shape expanding perpendicular to the terminal array direction.

Each of the end walls 32 includes an end groove 32A that houses a base portion 51, end arm portions 52, and a central arm portion 53 (described later) of the plug fixing fitting 50 and retains the end arm portion 52 press-fitted therein (refer to FIGS. 5A and 5B). The end groove 32A is formed in a slit-like shape expanding perpendicular to the terminal array direction.

In the present embodiment, at each corner position of the stationary housing 30 viewed from above, an intermediate part, in the up-down direction, of the side wall 31 and an upper half part of the end wall 32 are coupled to each other as can be seen in FIG. 3. As a result, a corner recess 34 that houses a restricted portion 45 (described later) of the movable housing 40 is formed under the junction between the side wall 31 and the end wall 32. As can be seen in FIG. 3, the corner recess 34 is open downward and penetrates the stationary housing 30 in the connector-width direction (X-axis direction) (refer to FIGS. 5A and 5B). Among inner wall surfaces defining the corner recess 34, an inner wall surface perpendicular to the up-down direction constitutes an upper restricting surface 34A that restricts upward movement of the restricted portion 45 of the movable housing 40. Among the inner wall surfaces defining the corner recess 34, an inner wall surface perpendicular to the terminal array direction (the inner wall surface formed on the end wall 32) constitutes an end restricting surface 34B that restricts movement of the restricted portion 45 of the movable housing 40 in the terminal array direction.

The movable housing 40 is inserted into and disposed in the stationary housing 30 from below the central space 33. As can be seen in FIG. 1A, the most part of the movable housing 40 except the upper end part and the restricted portion 45 (described later) is housed inside the central space 33 of the stationary housing 30. The movable housing 40 includes a pair of long walls 41 extending in the terminal array direction, a pair of short walls 42 that extends in the connector-width direction and couples ends of the pair of long walls 41, a bottom wall 43 (refer to FIGS. 2A and 2B) that closes, from blow, a space surrounded by a peripheral wall constituted from the pair of long walls 41 and the pair of short walls 42, a rising wall 44 (refer to FIGS. 2A and 2B) that rises from the bottom wall 43 and extends in the terminal array direction, and the restricted portions 45 each projecting outward in the connector-width direction from the lower part of the corresponding short wall 42. The space that is surrounded by the above-mentioned peripheral wall and open upward constitutes a receiving portion 46 for receiving a mating portion 72 (described later) of the receptacle connector 2. A substantially lower half part of the receiving portion 46 constitutes an annular space formed between the above-mentioned peripheral wall and the rising wall 44.

An outer wall surface of the long wall 41 is recessed within a range including a terminal array range to constitute a movable-side housing portion 41A that houses a part of the elastic portion 15 of each plug terminal 10. The movable-side housing portion 41A extends within a range from a position close to the upper end of the long wall 41 through the lower end thereof in the up-down direction, and has a closed upper end and an open lower end. As can be seen in FIG. 2A, when the elastic portion 15 of the plug terminal 10 is in the free state, the movable-side housing portion 41A houses the outer long arm portion 15F of the elastic portion 15.

As can be seen in FIG. 3, an outer side face (the face perpendicular to the connector-width direction) of a substantially lower half part of the short wall 42 projects and constitutes a restricted surface 41B extending in the up-down direction. The restricted surface 41B faces the inner wall surface of the side wall 31 of the stationary housing 30 with a clearance left therebetween in the connector-width direction. The movable housing 40 is movable in the connector-width direction within a range of the clearance between the restricted surface 41B and the inner wall surface (restricting surface) of the side wall 31, and further movement thereof outside the range is restricted by the restricted surface 41B coming into contact with the restricting surface.

As can be seen in FIG. 3, a restricted projection 42A projects from an outer end face (the face perpendicular to the terminal array direction) of the short wall 42 at a central position, in the connector-width direction, in a lower part of the short wall 42. The restricted projection 42A faces the upper face of a central leg portion 55 (described later) of the plug fixing fitting 50 with a clearance left therebetween. The movable housing 40 is movable downward within a range of the clearance between the restricted projection 42A and the upper face (restricting surface) of the central leg portion 55 of the plug fixing fitting 50, and further movement thereof outside the range is restricted by the restricted projection 42A coming into contact with the upper face of the central leg portion 55.

The bottom wall 43 includes the bottom grooves 43A (refer to FIG. 3) arranged in the terminal array direction. Each of the bottom grooves 43A houses and retains the movable-side retained portion 14 (described below) of the corresponding plug terminal 10 press-fitted therein. The bottom groove 43A has a slit-like shape expanding perpendicular to the terminal array direction and penetrates the bottom wall 43 in the up-down direction. The bottom groove 43A is also open outward in the connector-width direction and communicates with the movable-side housing portion 41A.

As can be seen in FIG. 2A, the rising wall 44 includes inner grooves 44A. Each of the inner grooves 44A houses the side edge of the contact portion 13 of the corresponding plug terminal 10. The inner groove 44A is recessed from the side face (the face perpendicular to the connector-width direction) of the rising wall 44 and extends in the up-down direction. The inner groove 44A penetrates the rising wall 44 in the up-down direction and has a lower end communicating with the corresponding bottom groove 43A of the bottom wall 43.

As can be seen in FIG. 3, the restricted portion 45 projects outward in the connector-width direction from the lower part of the short wall 42. The restricted portion 45 has a prism shape and is housed inside the corner recess 34 of the stationary housing 30. The restricted portion 45 faces the upper restricting surface 34A of the corner recess 34 in the up-down direction with a clearance left therebetween and faces the end restricting surface 34B of the corner recess 34 in the terminal array direction with a clearance left therebetween. Thus, the movable housing 40 is movable upward within a range of the clearance between the upper restricting surface 34A and the restricted portion 45, and further movement thereof outside the range is restricted by the restricted portion 45 coming into contact with the upper restricting surface 34A. Moreover, the movable housing 40 is movable in the terminal array direction within a range of the clearance between the end restricting surface 34B and the restricted portion 45, and further movement thereof outside the range is restricted by the restricted portion 45 coming into contact with the end restricting surface 34B.

The plug fixing fitting 50 is made by partially bending a sheet metal member. As can be seen in FIG. 3, the plug fixing fitting 50 includes the base portion 51 extending in the connector-width direction, the end arm portions 52 extending upward from respective ends, in the connector-width direction, of the base portion 51, a central arm portion 53 that extends upward from a central part, in the connector-width direction, of the base portion 51 and is shorter than the end arm portions 52, end leg portions 54 that are bent on the lower edges of the respective ends, in the connector-width direction, of the base portion 51 and extend outward in the terminal array direction, and a central leg portion 55 that is bent on the lower edge of the central part, in the connector-width direction, of the base portion 51 and extends inward in the terminal array direction.

The base portion 51, the end arm portions 52, and the central arm portion 53 are inserted into the slit-like end groove 32A (refer to FIG. 5A) formed on the end wall 32 of the stationary housing 30 from below. Each of the end arm portions 52 includes a plurality of projections on both side edges thereof. The plug fixing fitting 50 is press-fitted into and retained by the end wall 32 through the projections biting into the inner wall surface of the end groove 32A. The end leg portions 54 are fixed, on the lower faces thereof, to the mounting surface of the circuit board by means of soldering.

The central leg portion 55 includes a tip part (the part located on the inner side in the terminal array direction) having a tapered shape. The upper face of the tip part faces the lower face of the restricted projection 42A of the movable housing 40 (refer to FIGS. 5A and 5B). Thus, when the movable housing 40 displaces downward by a predetermined amount, the restricted projection 42A comes into contact with the upper face of the central leg portion 55, which restricts further displacement of the movable housing 40. Thus, the restricted projection 42A does not make direct contact with the mounting surface of the circuit board. As a result, damage of the circuit board is reduced.

Next, the configuration of the receptacle connector 2 will be described with reference to FIGS. 1A, 1B, 2A, and 2B. The receptacle connector 2 includes a plurality of receptacle terminals 60 made of metal, the receptacle terminals 60 being arranged in a terminal array direction corresponding to one direction parallel to the mounting surface of the circuit board (Y-axis direction in FIGS. 1A, 1B, 2A, and 2B), a receptacle housing 70 that is made of an electrical insulating material (e.g., resin) and retains the receptacle terminals 60, and receptacle fixing fittings 80 that are made of metal and retained on respective ends, in the terminal array direction, of the receptacle housing 70. As can be seen in FIGS. 1A, 1B, 2A, and 2B, the receptacle terminals 60 are arranged in two rows. The two rows of receptacle terminals 60 are opposed to each other with symmetrical orientations in the connector-width direction.

The receptacle terminal 60 is a female terminal that is made by bending a sheet metal member in the through-thickness direction. The receptacle terminal 60 includes, on one end, a connecting portion 61 that is solder-connected to the mounting surface of the circuit and includes, on the other end, a pair of contact pieces (not illustrated) contactable with the contact portion 13 of the plug terminal 10. Each of the contact pieces is a strip-like piece having major faces expanding perpendicular to the terminal array direction and elastically deformable in the through-thickness direction (terminal array direction). In a connector-mated state, the pair of contact pieces holds therebetween and presses the contact portion 13 of the plug terminal 10 and thus comes into contact with the contact portion 13. The receptacle terminal 60 is press-fitted into and thus attached to a terminal housing portion 74 (described later) from above (Z1 side in FIGS. 1A, 1B, 2A, and 2B).

The receptacle housing 70 includes a block portion 71 located at the circuit board side (the upper side in FIGS. 1A, 1B, 2A, and 2B) and the mating portion 72 projecting in the mating direction for mating to the plug connector 1 (downward in FIGS. 1A, 1B, 2A, and 2B) from the block portion 71. The block portion 71 and the mating portion 72 have a substantially rectangular parallelepiped outer shape with the longitudinal direction aligned with the terminal array direction.

The block portion 71 includes a recess 71A that is recessed in a central area in the connector-width direction (X-axis direction) and opens upward (Z1 direction in FIGS. 1A, 1B, 2A, and 2B). The recess 71A extends in the terminal array direction (Y-axis direction). The block portion 71 includes, on respective ends in the terminal array direction, fitting retaining grooves (not illustrated) for retaining the respective receptacle fixing fittings 80. Each of the fitting retaining grooves is formed in a slit-like shape expanding perpendicular to the terminal array direction.

The mating portion 72 includes a receiving portion 72A that is recessed in a central area in the connector-width direction (X-axis direction) and opens downward (Z1 direction in FIGS. 1A, 1B, 2A, and 2B). As can be seen in FIG. 2B, the receiving portion 72A is configured to receive the rising wall 44 of the movable housing 40 of the plug connector 1 from below in the connector-mated state. As can be seen in FIGS. 2A and 2B, a partition wall 73 is disposed between the block portion 71 and the mating portion 72 in the up-down direction to separate the block portion 71 and the mating portion 72 from each other.

The receptacle housing 70 includes terminal housing portions 74 for housing the respective receptacle terminals 60, the terminal housing portions 74 being arranged in the terminal array direction. Each of the terminal housing portion 74 extends over the entire range of the receptacle housing 70 in the up-down direction. The terminal housing portion 74 constitutes a groove extending along an inner wall surface of the recess 71A and an inner wall surface of the receiving portion 72A within the range of the recess 71A and the receiving portion 72A in the up-down direction and constitutes a hole penetrating the partition wall 73 within the range of the partition wall 73 in the up-down direction.

The receptacle fixing fitting 80 is made by bending a sheet metal member. The receptacle fixing fitting 80 is press-fitted into and retained by a fitting retaining groove (not illustrated) of the receptacle housing 70 from above (Z1 side in FIGS. 1A, 1B, 2A, and 2B). As can be seen in FIGS. 1A, 1B, 2A, and 2B, the receptacle fixing fitting 80 includes a fixing portion 81 extending outward in the connector-width direction outside the receptacle housing 70 and fixed, on the upper face thereof (the major face at the Z1 side in FIGS. 1A, 1B, 2A, and 2B), to the mounting surface of the circuit board by means of soldering.

Next, an operation of mating the plug connector 1 and the receptacle connector 2 will be described with reference to FIGS. 1A, 1B, 2A, and 2B.

First, the plug connector 1 and the receptacle connector 2 are mounted on the mounting surfaces of the respective circuit boards (not illustrated) through solder connection. Specifically, the plug connector 1 is attached to the circuit board through the connecting portion 11 of each plug terminal 10 and the end leg portion 54 of each plug fixing fitting 50 that are solder-connected to the mounting surface. The receptacle connector 2 is attached to the circuit board through the connecting portion 61 of each receptacle terminal 60 and the fixing portion 81 of each receptacle fixing fitting 80 that are solder-connected to the mounting surface.

Next, as can be seen in FIGS. 1A and 2A, the receptacle connector 2 in an attitude with the mating portion 72 facing downward is placed above the plug connector 1. Then, the receptacle connector 2 is lowered with the attitude maintained, and the mating portion 72 enters the receiving portion 46 of the movable housing 40 of the plug connector 1 and is thus mated with the movable housing 40 (refer to FIGS. 1B and 2B).

When the receptacle connector 2 is mated with the plug connector 1, the contact portion 13 of each plug terminal 10 enters between the pair of contact pieces of the corresponding receptacle terminal 60 from below. As a result, the pair of contact pieces of the receptacle terminal 60 holds therebetween and presses the contact portion 13 of the plug terminal 10, and thus comes into elastic contact with the contact portion 13 and is electrically connected thereto. In this manner, the operation of mating the plug connector 1 and the receptacle connector 2 is completed.

In the present embodiment, even if the plug connector 1 and the receptacle connector 2 are misaligned relative to each other immediately before the start of connector mating, the movable housing 40 of the plug connector 1 moves (floats) relative to the stationary housing 30 in the misaligned direction, which enables the mating.

FIGS. 5A and 5B illustrate a section of a part of the plug connector 1 (the part located at the Y1 side in the terminal array direction (Y-axis direction)) on a plane perpendicular to the up-down direction (XY plane) at a position immediately above the relay pieces 16 and 17 of the plug terminals 10 viewed from above. FIG. 5A illustrates a state where the movable housing 40 is located at the regular position. FIG. 5B illustrates a state where the movable housing 40 floats from the regular position.

As can be seen in FIG. 5A, when the movable housing 40 is not in a floating state and located at the regular position, as described above, the stationary-side contact portion 16C-1 of the stationary-side relay piece 16 is in contact, with contact pressure, with the major face of the movable-side elastic piece 17C at the position close to the inner end, in the connector-width direction, of the movable-side elastic piece 17C (the position close to the movable-side base end portion 17B). On the other hand, the movable-side contact portion 17C-1 of the movable-side relay piece 17 is in contact, with contact pressure, with the major face of the stationary-side elastic piece 16C at the position close to the outer end, in the connector-width direction, of the stationary-side elastic piece 16C (the position close to the stationary-side base end portion 16B).

If the movable housing 40 floats in the X1 direction in the connector-width direction and the Y2 direction in the terminal array direction from the regular position illustrated in FIG. 5A, the elastic portion 15 (not illustrated) elastically deforms in such a manner as to narrow the widened parts of the three waveform portions in the terminal array of the plug terminals 10 at the X1 side (the terminal array located in the lower half in FIG. 5A), whereas the elastic portion 15 (not illustrated) elastically deforms in such a manner as to expand the widened parts of the three waveform portions in the terminal array of the plug terminals 10 at the X2 side (the terminal array located in the upper half in FIG. 5A)

As a result, in the terminal array of the plug terminals 10 at the X1 side, the movable-side contact portion 17C-1 of the movable-side relay piece 17 slides in the X2 direction (upward in FIG. 5A) while being kept in contact with the major face of the stationary-side elastic piece 16C, and reaches the position of the stationary-side base end portion 16B of the stationary-side relay piece 16 and maintains the contact state with the major face of the stationary-side base end portion 16B as can be seen in FIG. 5B. The stationary-side contact portion 16C-1 of the stationary-side relay piece 16 is brought into contact with the major face of the movable-side base end portion 17B of the movable-side relay piece 17. At this time, as can be understood from the comparison between FIGS. 5A and 5B, an elastic deformation amount (the deformation amount in the Y-axis direction) of the relay pieces 16 and 17 is larger than that in the case where the movable housing 40 is located at the regular position.

On the other hand, in the terminal array of the plug terminals 10 at the X2 side, the movable-side contact portion 17C-1 of the movable-side relay piece 17 slides in the X1 direction (downward in FIG. 5A) while being kept in contact with the major face of the stationary-side elastic piece 16C, and reaches a position close to the stationary-side contact portion 16C-1 of the stationary-side elastic piece 16C and maintains, at this position, the contact state with the major face of the stationary-side elastic piece 16C as can be seen in FIG. 5B. The stationary-side contact portion 16C-1 of the stationary-side relay piece 16 is brought into contact with the major face of the movable-side elastic piece 17C at a position close to the movable-side contact portion 17C-1 of the movable-side elastic piece 17C. At this time, as can be understood from the comparison between FIGS. 5A and 5B, the elastic deformation amount (the deformation amount in the Y-axis direction) of the relay pieces 16 and 17 is smaller than that in the case where the movable housing 40 is located at the regular position.

In this manner, in the present embodiment, even if the movable housing 40 floats, the contact state between the relay pieces 16 and 17 is maintained, and, in turn, the signal transmission path passing through the relay pieces 16 and 17 is maintained.

In the present embodiment, the relay portion of the plug terminal 10 includes the stationary-side relay piece 16 serving as the first relay piece extending from the position closer to the one end (the connecting portion 11 side) than the elastic portion 15 is toward the position closer to the other end (the contact portion 13 side) than the elastic portion 15 is and the movable-side relay piece 17 serving as the second relay piece extending from the position closer to the other end than the elastic portion 15 is toward the position closer to the one end than the elastic portion 15 is. However, the mode of the relay portion is not limited thereto and can be variously modified.

As a modification, the relay portion of the plug terminal may be configured as an elastic piece extending from the position closer to the one end than the elastic piece is toward the position closer to the other end than the elastic portion is. In this modification, for example, in the plug terminal, the relay portion may be configured as an elastic piece that extends inward in the connector-width diction from the stationary-side coupling portion and makes elastic contact with the movable-side coupling portion. Moreover, as another modification, the relay portion may be configured as an elastic piece extending from the position closer to the other end than the elastic portion is toward the position closer to the one end than the elastic portion is. In this modification, for example, in the plug terminal, the relay portion may be configured as an elastic piece that extends outward in the connector-width diction from the movable-side coupling portion and makes elastic contact with the stationary-side coupling portion. In both the modifications, the elastic piece serving as the relay portion has a total length shorter than the total length of the elastic portion.

Second Embodiment

In the first embodiment, the relay piece serving as the relay portion of the terminal is disposed with the through-thickness direction thereof parallel to the mounting surface of the circuit board and is elastically deformable in the through-thickness direction. A second embodiment differs from the first embodiment in that a relay piece serving as a relay portion of a terminal is formed by cutting and raising a part of a strip-like elastic portion having a strip width parallel to a mounting surface of a circuit board and elastically deformable in the through-thickness direction.

Figure 6B:
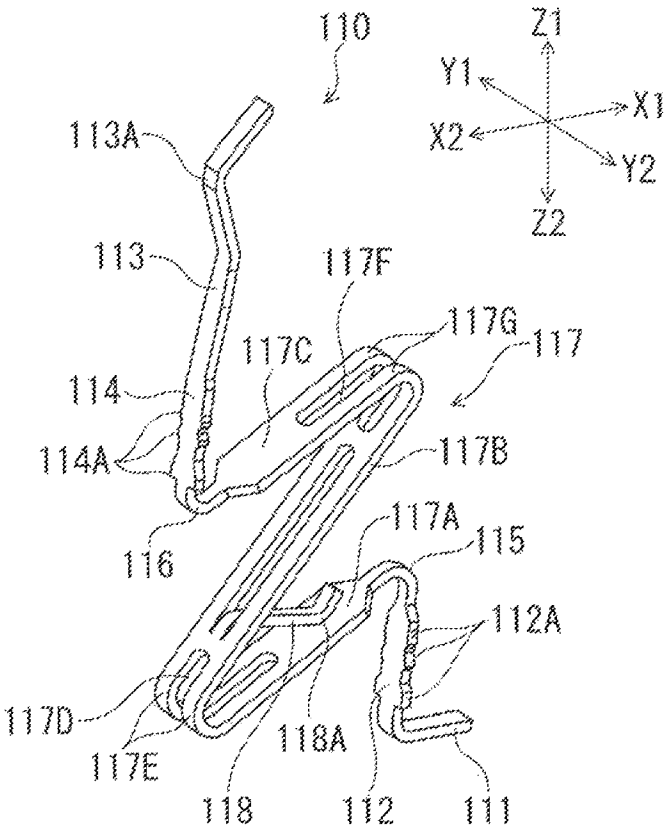
FIG. 6B is a perspective view of one receptacle terminal of the receptacle connector of FIG. 6A.
Figure 6A:
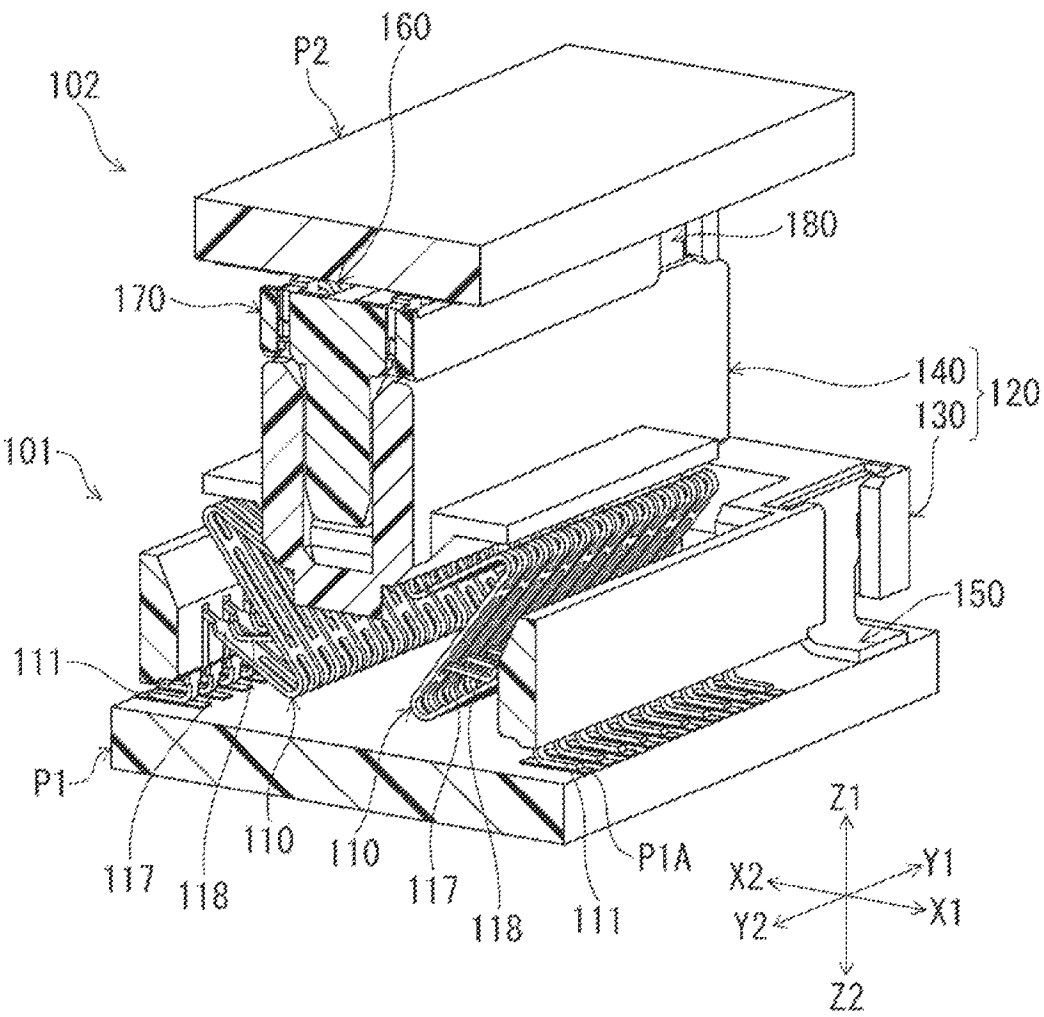
FIG. 6A is a perspective sectional view of a plug connector and a receptacle connector according to a second embodiment of the disclosure, illustrating sections on a plane perpendicular to the terminal array direction.

FIG. 6A is a perspective sectional view of a receptacle connector 101 and a plug connector 102 serving as a counterpart connector element (counterpart connector) thereof according to the present embodiment, illustrating sections on a plane perpendicular to a terminal array direction. FIG. 6A illustrates the connectors 101 and 102 in a mated state. FIG. 6B is a perspective view of one receptacle terminal 110 of the receptacle connector 101 of FIG. 6A. The receptacle connector 101 is mounted on a mounting surface of a circuit board P1. The plug connector 102 is mounted on a mounting surface of a circuit board P2 and mated to the receptacle connector 101 from above. As with the plug housing 20 of the plug connector 1 of the first embodiment, a receptacle housing 120 of the receptacle connector 101 includes a stationary housing 130 and a movable housing 140, and the movable housing 140 is movable (floatable) relative to the stationary housing 130.

In the present embodiment, the configuration of a receptacle terminal 110 (described later) provided on the receptacle connector 101 will be mainly described, and the other components are assigned reference numerals obtained by adding "100" to the reference numerals of the corresponding components in the first embodiment (e.g., a reference numeral "130" is assigned to the stationary housing) to omit description thereof. As can be seen in FIG. 6B, the receptacle terminal 110 of the present embodiment is a female terminal made by bending a strip-like sheet metal member in the through-thickness direction and cutting and raising a part thereof. The receptacle terminal 110 is retained by the stationary housing 130 and the movable housing 140 with the strip-width direction of the receptacle terminal 110 aligned with the terminal array direction (Y-axis direction) parallel to the mounting surface of the circuit board P1.

As can be seen in FIG. 6B, the receptacle terminal 110 includes a connecting portion 111, a stationary-side retained portion 112, a contact portion 113, a movable-side retained portion 114, a stationary-side coupling portion 115, a movable-side coupling portion 116, an elastic portion 117, and a relay piece 118.

The connecting portion 111 extends in the connector-width direction (X-axis direction) on one end of the receptacle terminal 110 and is solder-connected, on the lower face thereof, to a circuit portion P1A (refer to FIG. 6A) of the mounting surface of the circuit board P1. The stationary-side retained portion 112 is bent and extends from an end on the inner side (X2 side), in the connector-width direction, of the connecting portion 111. The stationary-side retained portion 112 includes stationary-side retained projections 112A projecting at a plurality of positions in the up-down direction on both side edges (the edges extending in the up-down direction) thereof. The stationary-side coupling portion 115 is bent inward in the connector-width direction on the upper end of the stationary-side retained portion 112 and couples the upper end of the stationary-side retained portion 112 to one end of the elastic portion 117.

The contact portion 113 extends in the up-down direction on the other end of the receptacle terminal 110 and is elastically deformable in the through-thickness direction (X-axis direction). The contact portion 113 includes, in the upper end part thereof, a contact projection 113A for making contact with a plug terminal 160 of the plug connector 102. The contact projection 113A is bent in such a manner as to project inward in the connector-width direction (X2 direction). The movable-side retained portion 114 extends downward from the lower end of the contact portion 113 and includes movable-side retained projections 114A projecting at a plurality of positions in the up-down direction on both side edges (the edges extending in the up-down direction) thereof. The movable-side coupling portion 116 is bent outward in the connector-width direction on the lower end of the movable-side retained portion 114 and couples the lower end of the movable-side retained portion 114 to the other end of the elastic portion 117.

The elastic portion 117 is wider than the other portions. The elastic portion 117 includes a lower arm portion 117A, an intermediate arm portion 117B, and an upper arm portion 117C (described below), and has a substantially Z shape as a whole when viewed in the terminal array direction. The lower arm portion 117A extends inward in the connector-width direction (X2 direction) from the stationary-side coupling portion 115 at a slight downward inclination. The intermediate arm portion 117B is bent on the inner end, in the connector-width direction, of the lower arm portion 117A and extends outward in the connector-width direction (X1 direction) at an upward inclination. The upper arm portion 117C is bent on the outer end, in the connector-width direction, of the intermediate arm portion 117B, extends inward in the connector-width direction at a slight downward inclination, and is coupled to the movable-side coupling portion 116. The elastic portion 117 is elastically deformable in such a manner as to expand or narrow the distance between the lower arm portion 117A and the intermediate arm portion 117B and the distance between the intermediate arm portion 117B and the upper arm portion 117C.

The elastic portion 117 includes a lower slit 117D within a range including the junction between the lower arm portion 117A and the intermediate arm portion 117B along the longitudinal direction of the elastic portion 117. The lower slit 117D penetrates the elastic portion 117 in the through-thickness direction in a central area, in the strip-width direction, of the elastic portion 117. The elastic portion 117 includes bent portions 117E that are narrow and formed on respective sides of the lower slit 117D in the strip-width direction. Similarly, the elastic portion 117 also includes an upper slit 117F within a range including the junction between the intermediate arm portion 117B and the upper arm portion 117C, and bent portions 117G that are narrow and formed on respective sides of the upper slit 117F. The narrow bent portions 117E and the narrow bent portions 117G formed on the elastic portion 117 in this manner facilitate elastic deformation of the elastic portion 117.

The relay piece 118 is formed by cutting and raising a part of the intermediate arm portion 117B in a central area in the strip-width direction at a position between the lower slit 117D and the upper slit 117F in the longitudinal direction of the intermediate arm portion 117B. The relay piece 118 has a cantilever form extending outward in the connector-width direction from a position close to the inner end, in the connector-width direction, of the intermediate arm portion 117B at a downward inclination. The relay piece 118 includes, in a free end part thereof, a relay projection 118A that is bent in such a manner as to project downward. The relay projection 118A is in contact, with contact pressure, with the upper face (major face) of the lower arm portion 117A. As a result, the signal transmission path passing through the relay piece 118 is formed in the receptacle terminal 110. The signal transmission path passing through the relay piece 118 is shorter than a total length of the elastic portion 117. Thus, a signal transmitted in the receptacle terminal 110 is more likely to flow through the signal transmission path passing through the relay piece 118 than through the signal transmission path passing through the entire elastic portion 117. That is, in the receptacle terminal 110, the relay piece 118 short-circuits both ends of a part of the elastic portion 117.

According to the present embodiment, as with the first embodiment, a sufficient floating amount is ensured by the elastic portion 117 having a sufficient spring length. In addition, a sufficient electrical characteristic for signal transmission can also be ensured by the relay piece 118 constituting the signal transmission path shorter than the total length of the elastic portion 117 separately from the elastic portion 117.

In the present embodiment, in floating of the movable housing 140, if elastic deformation of the elastic portion 117 reduces the distance between the lower arm portion 117A and the intermediate arm portion 117B, the relay projection 118A of the relay piece 118 moves outward in the connector-width direction, that is, toward the stationary-side coupling portion 115 while being kept in contact with the upper face of the lower arm portion 117A. On the other hand, if elastic deformation of the elastic portion 117 increases the distance between the lower arm portion 117A and the intermediate arm portion 117B, the relay projection 118A of the relay piece 118 moves inward in the connector-width direction, that is, toward the junction with the lower arm portion 117A while being kept in contact with the upper face of the lower arm portion 117A. In this manner, even if the movable housing 140 floats, the contact state between the relay piece 118 and the lower arm portion 117A is maintained, and, in turn, the signal transmission path passing through the relay piece 118 is maintained.

In the present embodiment, the relay piece 118 relays the intermediate arm portion 117B and the lower arm portion 117A. Alternatively, for example, the relay piece 118 may relay the intermediate arm portion and the upper arm portion. In this case, for example, a relay piece cut and raised from a part of the intermediate arm portion may be brought into contact with the lower face of the upper arm portion.

Third Embodiment

In the first embodiment, the relay portion for forming the signal transmission path shorter than the total length of the elastic portion is provided on a part of the terminal. A third embodiment differs from the first embodiment in that a relay member for forming a signal transmission path shorter than a total length of an elastic portion is provided as a member separate from a terminal.

Figure 7B:
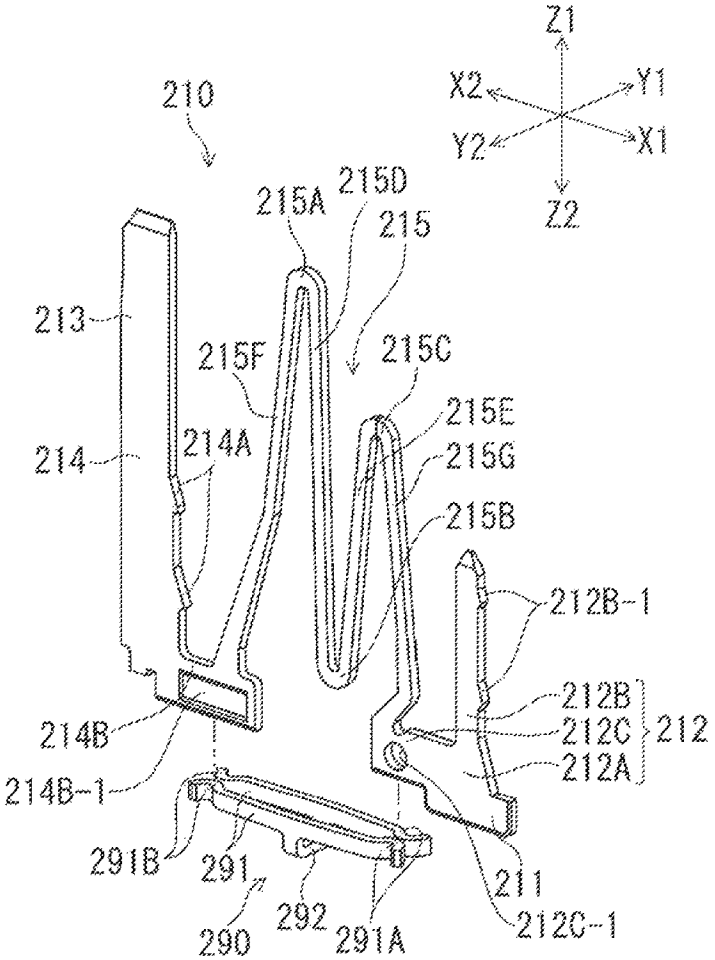
FIG. 7B is a perspective view of one plug terminal of the plug connector of FIG. 7A.
Figure 7A:
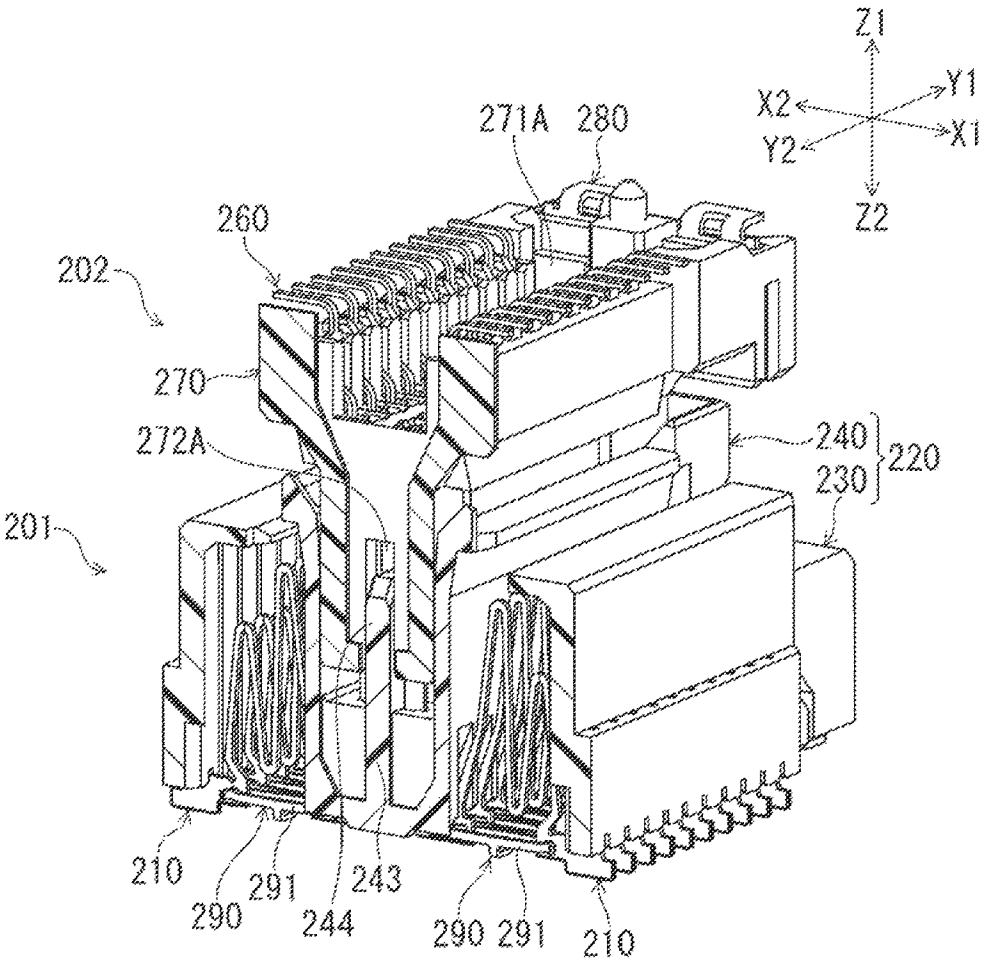
FIG. 7A is a perspective sectional view of a plug connector and a receptacle connector according to a third embodiment of the disclosure, illustrating sections on a plane perpendicular to the terminal array direction.

FIG. 7A is a perspective sectional view of a plug connector 201 and a receptacle connector 202 serving as a counterpart connector element (counterpart connector) thereof according to the present embodiment, illustrating sections on a plane perpendicular to a terminal array direction. FIG. 7B is a perspective view of one plug terminal 210 of the plug connector 201 of FIG. 7A. FIG. 7A illustrates the connectors 201 and 202 in a mated state. The plug connector 201 and the receptacle connector 202 are mounted on respective mounting surfaces of different circuit boards (not illustrated). The receptacle connector 202 is mated to the plug connector 201 from above. As with the plug housing 20 of the plug connector 1 of the first embodiment, a plug housing 220 of the plug connector 201 includes a stationary housing 230 and a movable housing 240, and the movable housing 240 is movable (floatable) relative to the stationary housing 230.

In the present embodiment, the configuration of a plug terminal 210 (described later) provided on the plug connector 201 and a relay member 290 (described later) will be mainly described, and the other components are assigned reference numerals obtained by adding "200" to the reference numerals of the corresponding components in the first embodiment (e.g., a reference numeral "230" is assigned to the stationary housing) to omit description thereof. As can be seen in FIG. 7B, the plug terminal 210 of the present embodiment has a shape obtained by eliminating the relay pieces 16 and 17 from the plug terminal 10 of the first embodiment. In FIG. 7B, the components of the plug terminal 210 are assigned reference numerals obtained by adding "200" to the reference numerals of the corresponding components of the plug terminal 10.

In the plug terminal 210, a stationary-side coupling portion 212C and a movable-side coupling portion 214B are larger in dimension in the up-down direction than the stationary-side coupling portion 12C and the movable-side coupling portion 14B of the plug terminal 10. The stationary-side coupling portion 212C includes a contact hole 212C-1 having a circular shape. The contact hole 212C-1 penetrates the stationary-side coupling portion 212C in the through-thickness direction. On the other hand, the movable-side coupling portion 214B includes contact recesses 241B-1 each having a rectangular shape with the longitudinal direction aligned with the connector-width direction. The contact recesses 214B-1 are recessed on respective major faces of the movable-side coupling portion 214B.

The plug connector 201 includes the relay member 290 configured as a member separate from the plug terminal 210. The relay member 290 is made by bending a sheet metal member. As can be seen in FIG. 7B, the relay member 290 includes a pair of relay pieces 291 extending in the connector-width direction (X-axis direction) and a coupling portion 292 coupling the relay pieces 291.

The pair of relay pieces 291 is disposed with the through-thickness direction aligned with the terminal array direction (Y-axis direction) and elastically deformable in the through-thickness direction. A dimension of each of the relay pieces 291 in the longitudinal direction, that is, in the connector-width direction is shorter than a total length of an elastic portion 215 of the plug terminal 210. Each of the relay pieces 291 includes, on respective ends in the connector-width direction, a relay projection 291A and a relay projection 291B that are bent in the through-thickness direction. The relay projections 291A of the respective relay pieces 291 project in such a manner as to become close to each other in the terminal array direction (Y-axis direction). The relay projections 291B of the respective relay pieces 291 project in such a manner as to become close to each other in the terminal array direction (Y-axis direction). In the present embodiment, the relay projection 291A on one end located at the stationary-side coupling portion 212C side is referred to as the "stationary-side relay projection 291A", whereas the relay projection 291B on the other end located at the movable-side coupling portion 214B side is referred to as the "movable-side relay projection 291B". The coupling portion 292 is bent in a substantially U shape when viewed in the connector-width direction and couples the lower ends of the respective relay pieces 291 in a central area in the connector-width direction.

The relay member 290 is attached to the plug terminal 210 by inserting the stationary-side coupling portion 212C between the pair of stationary-side relay projections 291A and inserting the movable-side coupling portion 214B between the pair of movable-side relay projections 291B (refer to FIG. 7A). In a state where the relay member 290 is attached to the plug terminal 210, the pair of stationary-side relay projections 291A enters the contact hole 212C-1 of the stationary-side coupling portion 212C from both sides. As a result, the pair of stationary-side relay projections 291A is locked to and comes into contact with the peripheral edge of the contact hole 212C-1. On the other hand, the pair of movable-side relay projections 291B holds therebetween and presses the major faces of the contact recesses 214B-1 of the movable-side coupling portion 214B from both sides. As a result, the pair of movable-side relay projections 291B is lockable to the peripheral edges of the contact recesses 214B-1 and comes into contact with the major faces described above.

In this manner, the pair of stationary-side relay projections 291A making contact with the peripheral edge of the contact hole 212C-1 and the pair of movable-side relay projections 291B making contact with the major faces of the contact recesses 214B-1 constitute a signal transmission path passing through the relay member 290. The signal transmission path passing through the pair of relay pieces 291 of the relay member 290 is shorter than the total length of the elastic portion 215 of the plug terminal 210. Thus, a signal transmitted in the plug terminal 210 is more likely to flow through the signal transmission path passing through the pair of relay pieces 291 than through the signal transmission path passing through the entire elastic portion 215. That is, in the plug terminal 210, the relay member 290 short-circuits the stationary-side coupling portion 212C located closer to one end than the elastic portion 215 is and the movable-side coupling portion 214B located closer to the other end than the elastic portion 215 is.

According to the present embodiment, as with the first embodiment, a sufficient floating amount is ensured by the elastic portion 215 having a sufficient spring length. In addition, a sufficient electrical characteristic for signal transmission can also be ensured by the relay member 290 constituting the signal transmission path shorter than the total length of the elastic portion 215 separately from the elastic portion 215.

In the present embodiment, as with the first embodiment, in floating of the movable housing 240, the elastic portion 215 having a substantially M shape of the plug terminal 210 elastically deforms in such a manner as to expand or narrow each widened part in the connector-width direction (X-axis direction). Moreover, in the present embodiment, the contact recesses 214B-1 contactable with the respective movable-side relay projections 291B of the relay member 290 have a rectangular shape elongated in the connector-width direction. The movable-side relay projections 291B are slidable within a range of the contact recesses 214B-1 in the connector-width direction while being kept in contact with the major faces of the contact recesses 214B-1. Thus, even if the movable housing 240 floats, the movable-side relay projections 291B slide in response to elastic deformation of the plug terminal 210, which maintains the contact state between the movable-side relay projections 291B and the contact recesses 214B-1 and, in turn, maintains the signal transmission path passing through the relay member 290.

Fourth Embodiment

In the second embodiment, the relay portion cut and raised from a part of the terminal is brought into contact with another part of the terminal. A fourth embodiment differs from the second embodiment in that a relay portion cut and raised from a part of a terminal is brought into contact with a pad on a mounting surface of a circuit board.

Figure 8B:
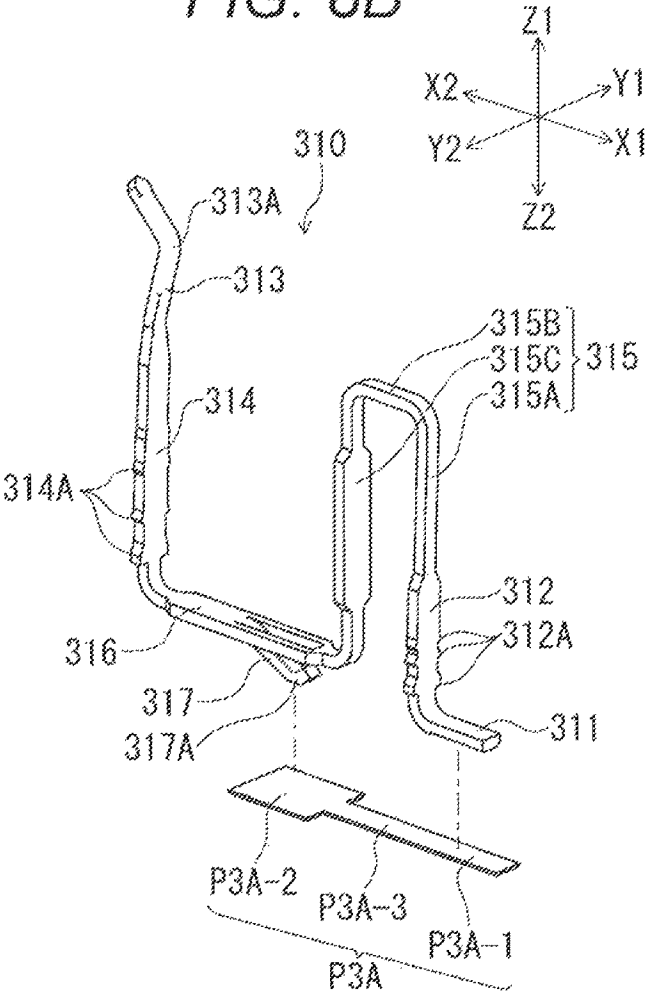
FIG. 8B is a perspective view of one receptacle terminal of the receptacle connector of FIG. 8A.
Figure 8A:
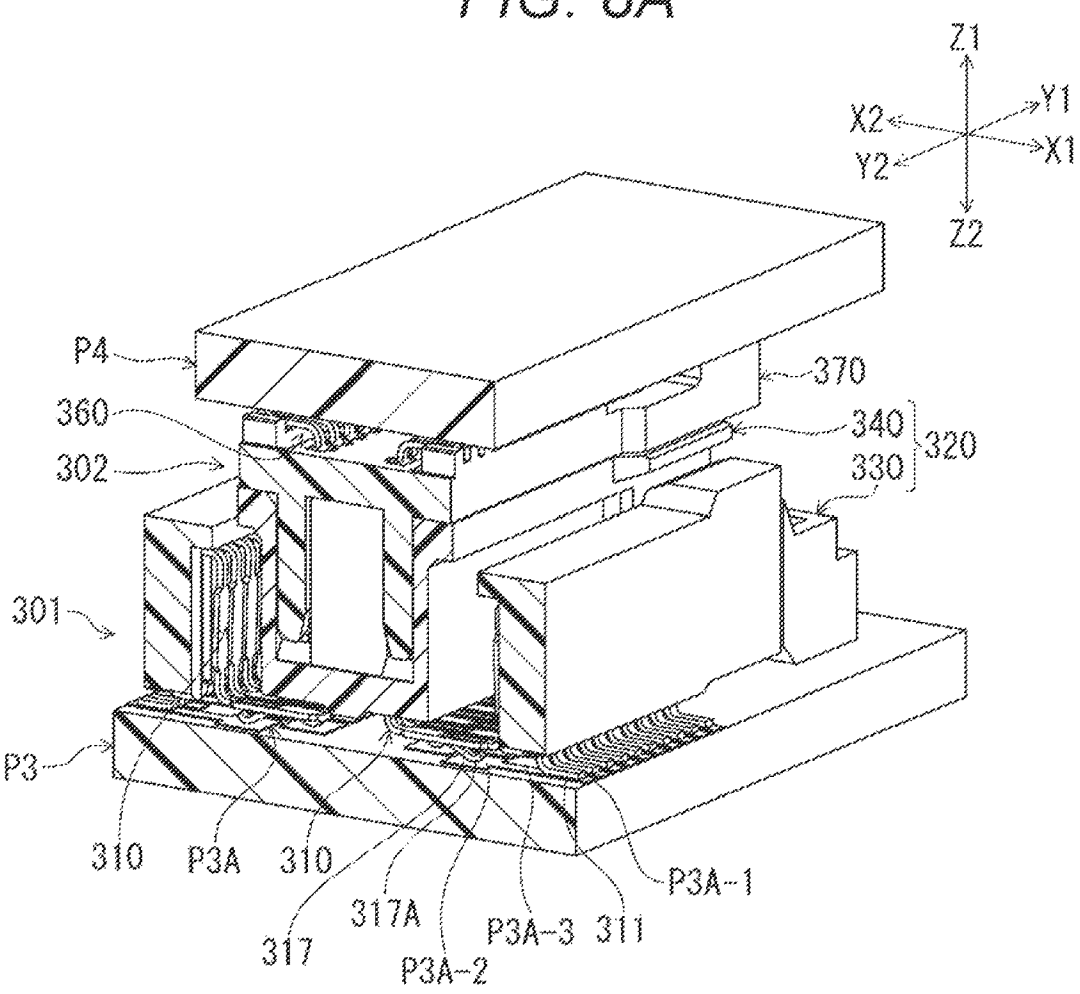
FIG. 8A is a perspective sectional view of a plug connector and a receptacle connector according to a fourth embodiment of the disclosure, illustrating sections on a plane perpendicular to the terminal array direction.

FIG. 8A is a perspective sectional view of a receptacle connector 301 and a plug connector 302 serving as a counterpart connector element (counterpart connector) thereof according to the present embodiment, illustrating sections on a plane perpendicular to a terminal array direction. FIG. 8B is a perspective view of one receptacle terminal 310 of the receptacle connector 301 of FIG. 8A. FIG. 8A illustrates the connectors 301 and 302 in a mated state. The receptacle connector 301 is mounted on a mounting surface of a circuit board P3. The plug connector 302 is mounted on a mounting surface of a circuit board P4 and mated to the receptacle connector 301 from above. As with the receptacle housing 120 of the receptacle connector 101 of the second embodiment, a receptacle housing 320 of the receptacle connector 301 includes a stationary housing 330 and a movable housing 340, and the movable housing 340 is movable (floatable) relative to the stationary housing 330.

In the present embodiment, the configuration of a receptacle terminal 310 (described later) provided on the receptacle connector 301 will be mainly described, and the other components are assigned reference numerals obtained by adding "300" to the reference numerals of the corresponding components in the second embodiment (e.g., a reference numeral "330" is assigned to the stationary housing) to omit description thereof. As can be seen in FIG. 8A, the circuit board P3 includes a circuit portion P3A exposed on the mounting surface. As can be seen in FIG. 8B, the circuit portion P3A includes a first pad P3A-1 that makes contact with a connecting portion 311 (described later) of the receptacle terminal 310 and is solder-connected to the connecting portion 311, a second pad P3A-2 that is located inward in the connector-width direction relative to the first pad P3A-1 and makes contact with a relay contact portion 317A (described later) of the receptacle terminal 310, and a signal transmission portion P3A-3 that extends in the connector-width direction between the first pad P3A-1 and the second pad P3A-2 and connects the pads P3A-1 and P3A-2 to each other. A dimension of the signal transmission portion P3A-3 in the longitudinal direction, that is, the connector-width direction is shorter than a total length of an elastic portion 315 (described later) of the receptacle terminal 310. The second pad P3A-2 has a larger width dimension (a larger dimension in the Y-axis direction) than the first pad P3A-1 and the signal transmission portion P3A-3.

As can be seen in FIG. 8B, the receptacle terminal 310 of the present embodiment is a female terminal made by bending a strip-like sheet metal member in the through-thickness direction and cutting and raising a part thereof. The receptacle terminal 310 is retained by the stationary housing 330 and the movable housing 340 with the strip-width direction of the receptacle terminal 310 aligned with the terminal array direction (Y-axis direction) parallel to the mounting surface of the circuit board P3.

As can be seen in FIG. 8B, the receptacle terminal 310 includes the connecting portion 311, a stationary-side retained portion 312, a contact portion 313, a movable-side retained portion 314, the elastic portion 315, a lower arm portion 316, and a relay piece 317.

The connecting portion 311 extends in the connector-width direction on one end of the receptacle terminal 310. When the receptacle connector 301 is mounted on the circuit board P3, the connecting portion 311 is solder-connected, on the lower face thereof, to the first pad P3A-1 on the mounting surface of the circuit board P3. The stationary-side retained portion 312 is bent on the inner end, in the connector-width direction, of the connecting portion 311 and extends upward. The stationary-side retained portion 312 includes stationary-side retained projections 312A projecting at a plurality of positions in the up-down direction on both side edges (the edges extending in the up-down direction) thereof.

The contact portion 313 extends in the up-down direction on the other end of the receptacle terminal 310 and is elastically deformable in the through-thickness direction (connector-width direction). The receptacle terminal 310 includes, in the upper end part thereof, a contact projection 313A for making contact with a plug terminal 360 of the plug connector 302. The contact projection 313A is bent in such a manner as to project outward in the connector-width direction (X1 direction in FIG. 8B). The movable-side retained portion 314 extends downward from the lower end of the contact portion 313 and includes movable-side retained projections 314A projecting at a plurality of positions in the up-down direction on both side edges (the edges extending in the up-down direction) thereof.

The elastic portion 315 includes an outer arm portion 315A extending upward from the stationary-side retained portion 312, a transitional portion 315B that is bent on the upper end of the outer arm portion 315A and extends inward in the connector-width direction (the X2 direction in FIG. 8B), and an inner arm portion 315C that is bent on the inner end, in the connector-width direction, of the transitional portion 315B and extends downward. The elastic portion 315 has a substantially inverted U shape as a whole when viewed in the terminal array direction. As can be seen in FIG. 8B, the inner arm portion 315C is longer than the outer arm portion 315A.

The lower arm portion 316 is bent on the lower end of the inner arm portion 315C at a position slightly above the connecting portion 311, extends inward in the connector-width direction, and is coupled to the lower end of the movable-side retained portion 314. The relay piece 317 is formed by cutting and raising a part of the lower arm portion 316 in a central area, in the strip-width direction, of the lower arm portion 316. The relay piece 317 has a cantilever form extending outward in the connector-width direction from a substantially central position in the connector-width direction at a slight downward inclination. The relay piece 317 includes, in a free end part thereof, the relay contact portion 317A that is bent in such a manner as to project downward.

In a state where the receptacle connector 301 is mounted on the circuit board P3, the relay contact portion 317A is in contact, with contact pressure, with the second pad P3A-2 of the circuit board P3 under an elastically deformed state of the relay piece 317. As a result, a signal transmission path passing through the relay piece 317 and the circuit portion P3A of the circuit board P3 is formed in the receptacle terminal 310. The signal transmission path passing through the relay piece 317 and the circuit portion P3A, that is, passing through the relay piece 317, the second pad P3A-2, the signal transmission portion P3A-3, and the first pad P3A-1 is shorter than the total length of the elastic portion 315. Thus, a signal transmitted in the receptacle terminal 310 is more likely to flow through the signal transmission path passing through the relay piece 317 and the circuit portion P3A than through the signal transmission path passing through the entire elastic portion 315. That is, in the receptacle terminal 310, the relay piece 317 and the circuit portion P3A short-circuit an inner end part of the lower arm portion 316 located closer to the other end than the elastic portion 315 is (the part located at the X2 side in FIGS. 8A and 8B) and the second pad P3A-2 of the circuit portion P3A.

According to the present embodiment, as with the second embodiment, a sufficient floating amount is ensured by the elastic portion 315 having a sufficient spring length. In addition, a sufficient electrical characteristic for signal transmission can also be ensured by the relay piece 317 and the circuit portion P3A constituting the signal transmission path shorter than the total length of the elastic portion 315 separately from the elastic portion 315.

In the present embodiment, in floating of the movable housing 340, the elastic portion 315 elastically deforms in such a manner as to expand or narrow the distance between the outer arm portion 315A and the inner arm portion 315C in the connector-width direction (X-axis direction). Moreover, in the present embodiment, the relay contact portion 317A of the relay piece 317 is slidable in the connector-width direction while being kept in contact with the upper face of the second pad P3A-2 of the circuit board P3. Thus, even if the movable housing 340 floats, the contact state between the relay piece 317 and the second pad P3A-2 is maintained, and, in turn, the signal transmission path passing through the relay piece 317 and the second pad P3A-2 is maintained.

In the present embodiment, the free end part of the relay piece 317 in a cantilever form includes the relay contact portion 317A. However, the mode of the relay contact portion is not limited thereto. For example, the relay contact portion may be configured as a projection projecting from the lower face of the lower arm portion of the receptacle terminal.

In the first to fourth embodiments, the counterpart connector serving as the counterpart connector element is the electrical connector for circuit boards. However, the mode of the counterpart connector is not limited thereto. For example, the counterpart connector may be an electrical connector for cables. Moreover, it is not essential that the counterpart connector element be an electrical connector. For example, the counterpart connector element may be a circuit board that is inserted into and connected to the connector according to the present disclosure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electrical connector for circuit boards comprising:

a terminal including a connecting portion for connection to a circuit board, the connecting portion being disposed on one end of the terminal, and a contact portion for contact with a counterpart connector element, the contact portion being disposed on another end of the terminal; and a housing retaining the terminal, the housing including a stationary housing for mounting to the circuit board through the terminal and a movable housing movable relative to the stationary housing and receiving the contact portion of the terminal, wherein the terminal includes a stationary-side retained portion retained by the stationary housing, a movable-side retained portion retained by the movable housing, an elastic portion located between the stationary-side retained portion and the movable-side retained portion and elastically deformable, and a relay portion constituting a signal transmission path shorter than a total length of the elastic portion, and the relay portion short-circuits a part located at a position closer to the one end than the elastic portion is and a part located at a position closer to the other end than the elastic portion is or short-circuits both ends of a part of the elastic portion.

2. The electrical connector for circuit boards according to claim 1, wherein the relay portion includes a first relay piece extending from the position closer to the one end than the elastic portion is toward the position closer to the other end than the elastic portion is and a second relay piece extending from the position closer to the other end than the elastic portion is toward the position closer to the one end than the elastic portion is, the first relay piece and the second relay piece being in elastic contact with each other, and a total length of the first relay piece and the second relay piece in a contact state is shorter than the total length of the elastic portion.

3. The electrical connector for circuit boards according to claim 1, wherein the relay portion includes an elastic piece extending from the position closer to the one end than the elastic portion is toward the position closer to the other end than the elastic portion is or an elastic piece extending from the position closer to the other end than the elastic portion is toward the position closer to the one end than the elastic portion is, and a total length of the relay piece is shorter than the total length of the elastic portion.

4. The electrical connector for circuit boards according to claim 1, wherein the terminal is made of a sheet metal, and the relay portion is elastically deformable in a through-thickness direction parallel to a mounting surface of the circuit board.

5. The electrical connector for circuit boards according to claim 1, wherein the terminal is made of a sheet metal, the elastic portion has a strip shape bent in a through-thickness direction and is disposed with a strip-width direction parallel to a mounting surface of the circuit board, and the relay portion includes a relay piece having a cantilever form cut and raised from a part of the elastic portion and having elasticity, the relay portion is in elastic contact with the elastic portion in a free end part of the relay piece, and a total length of the relay portion is shorter than the total length of the elastic portion.

6. An electrical connector for circuit boards comprising:

a terminal including a connecting portion for connection to a circuit board, the connecting portion being disposed on one end of the terminal, and a contact portion for contact with a counterpart connector element, the contact portion being disposed on another end of the terminal; and a housing retaining the terminal, the housing including a stationary housing for mounting to the circuit board through the terminal and a movable housing movable relative to the stationary housing and receiving the contact portion of the terminal, wherein the terminal includes a stationary-side retained portion retained by the stationary housing, a movable-side retained portion retained by the movable housing, and an elastic portion located between the stationary-side retained portion and the movable-side retained portion and elastically deformable, the electrical connector for circuit boards further comprises a relay member configured as a member separate from the terminal, and the relay member makes contact with the terminal at both a position closer to the one end than the elastic portion is and a position closer to the other end than the elastic portion is to constitute a signal transmission path shorter than a total length of the elastic portion and short-circuits parts located at both the positions.

7. A circuit-board-mounted electrical connector comprising:

a circuit board; and an electrical connector mounted on the circuit board, wherein the electrical connector includes a terminal including a connecting portion for connection to the circuit board, the connecting portion being disposed on one end of the terminal, and a contact portion for contact with a counterpart connector element, the contact portion being disposed on another end of the terminal, and a housing retaining the terminal, the housing including a stationary housing for mounting to the circuit board through the terminal and a movable housing movable relative to the stationary housing and receiving the contact portion of the terminal, the terminal includes a stationary-side retained portion retained by the stationary housing, a movable-side retained portion retained by the movable housing, an elastic portion located between the stationary-side retained portion and the movable-side retained portion and elastically deformable, and a relay contact portion disposed at a position closer to the other end than the elastic portion is, the circuit board includes a circuit portion exposed on a mounting surface of the circuit board, the circuit portion including a first pad contactable with the connecting portion, a second pad contactable with the relay contact portion, and a signal transmission portion shorter than a total length of the elastic portion and connecting the first pad and the second pad, and the relay contact portion and the circuit portion constitute a signal transmission path shorter than the total length of the elastic portion and short-circuit a part of the terminal located at a position closer to the other end than the elastic portion is and the second pad of the circuit portion in a state where the electrical connector is mounted on the circuit board.

* * * * *